US011707097B2

(12) United States Patent
Choi et al.

(10) Patent No.: US 11,707,097 B2
(45) Date of Patent: Jul. 25, 2023

(54) MASK APPARATUS

(71) Applicant: LG Electronics Inc., Seoul (KR)

(72) Inventors: Chiyoung Choi, Seoul (KR); Taeun Heo, Seoul (KR); Hojung Kim, Seoul (KR); Byeongwook Kim, Seoul (KR); Wansu Youn, Seoul (KR); Sangkyun Baek, Seoul (KR); Yeongcheol Mun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 45 days.

(21) Appl. No.: 17/170,035

(22) Filed: Feb. 8, 2021

(65) Prior Publication Data

US 2021/0378326 A1 Dec. 9, 2021

(30) Foreign Application Priority Data

Jun. 5, 2020 (KR) ..... 10-2020-0068421

(51) Int. Cl.

| | |
|---|---|
| ***A41D 13/11*** | (2006.01) |
| ***A62B 18/02*** | (2006.01) |
| ***A62B 18/08*** | (2006.01) |

(52) U.S. Cl.

CPC ..... *A41D 13/1146* (2013.01); *A41D 13/1161* (2013.01); *A62B 18/02* (2013.01); *A62B 18/08* (2013.01); *A62B 18/084* (2013.01)

(58) Field of Classification Search

CPC ..... A41D 13/1146; A41D 13/1161; A62B 18/02; A62B 18/08; A62B 18/084

See application file for complete search history.

(56) References Cited

U.S. PATENT DOCUMENTS

| | | | |
|---|---|---|---|
| 6,213,119 | B1 | 4/2001 | Brydon et al. |
| 10,342,999 | B2 | 7/2019 | Song et al. |

(Continued)

FOREIGN PATENT DOCUMENTS

| | | |
|---|---|---|
| CN | 103751919 | 4/2014 |
| CN | 104162236 | 11/2014 |

(Continued)

OTHER PUBLICATIONS

Extended European Search Report in European Appln. No. 20217533.7, dated Jun. 8, 2021, 5 pages.

(Continued)

*Primary Examiner* — Rachael E Bredefeld
*Assistant Examiner* — Seth R. Brown
(74) *Attorney, Agent, or Firm* — Fish & Richardson P.C.

(57) ABSTRACT

A mask apparatus includes a mask body, a pair of hook mounting portions at side ends of the mask body, a seal coupled to a rear surface of the mask body, and a pair of ear hook portions connected to the hook mounting portions. Each hook mounting portion includes an upper hook mounting portion, a lower hook mounting portion below the upper hook mounting portion, a hook pin at each of the upper hook mounting portion and the lower hook mounting portion, and a through-hole defined in each of the upper hook mounting portion and the lower hook mounting portion. Each ear hook portion includes a strap portion, a first hook portion connecting the strap portion to one of the upper and lower hook mounting portions, and a second hook portion connecting the strap portion to the other of the upper and lower hook mounting portions.

20 Claims, 14 Drawing Sheets

(56) References Cited

U.S. PATENT DOCUMENTS

| | | | | |
|---|---|---|---|---|
| 10,661,104 | B2 | 5/2020 | Morgan et al. | |
| 2003/0066257 | A1 | 4/2003 | Shovlin | |
| 2003/0066527 | A1 | 4/2003 | Chen | |
| 2007/0125385 | A1 | 6/2007 | Ho et al. | |
| 2010/0101575 | A1 | 4/2010 | Fedorko et al. | |
| 2015/0202473 | A1 | 7/2015 | Curran et al. | |
| 2015/0217144 | A1* | 8/2015 | Skov | A62B 18/10 128/202.27 |
| 2015/0217146 | A1* | 8/2015 | Skov | A62B 18/025 128/202.27 |
| 2015/0289598 | A1* | 10/2015 | Hsiung | A44B 11/2588 128/202.27 |
| 2015/0362478 | A1 | 12/2015 | Phillips | |
| 2016/0001111 | A1 | 1/2016 | Morgan et al. | |
| 2016/0022944 | A1* | 1/2016 | Chodkowski | A61M 16/0622 128/206.24 |
| 2016/0030779 | A1 | 2/2016 | Twu et al. | |
| 2017/0157353 | A1 | 6/2017 | Olsen et al. | |
| 2018/0078798 | A1 | 3/2018 | Fabian et al. | |
| 2018/0177965 | A1* | 6/2018 | Patel | A61M 16/0616 |
| 2018/0236275 | A1 | 8/2018 | Song et al. | |
| 2019/0009114 | A1* | 1/2019 | Han | A41D 1/002 |
| 2019/0113501 | A1 | 4/2019 | Jameson et al. | |
| 2019/0160249 | A1* | 5/2019 | Rose | A61M 16/0683 |
| 2019/0175962 | A1 | 6/2019 | Su et al. | |
| 2020/0086071 | A1* | 3/2020 | Lin | A61M 16/0816 |

FOREIGN PATENT DOCUMENTS

| | | | | |
|---|---|---|---|---|
| CN | 104826247 | | 8/2015 | |
| CN | 105126219 | | 12/2015 | |
| CN | 105641821 | | 6/2016 | |
| CN | 205285072 | | 6/2016 | |
| CN | 106039607 | | 10/2016 | |
| CN | 106730464 | | 5/2017 | |
| CN | 206459266 | U | 9/2017 | |
| CN | 107224687 | | 10/2017 | |
| CN | 206577264 | | 10/2017 | |
| CN | 107308564 | | 11/2017 | |
| CN | 207011751 | | 2/2018 | |
| CN | 207040968 | | 2/2018 | |
| CN | 207041756 | | 2/2018 | |
| CN | 207152901 | | 3/2018 | |
| CN | 207604526 | | 7/2018 | |
| CN | 207721249 | | 8/2018 | |
| CN | 108635689 | | 10/2018 | |
| CN | 208145256 | | 11/2018 | |
| CN | 109078277 | | 12/2018 | |
| CN | 208403333 | | 1/2019 | |
| EP | 0558147 | | 9/1993 | |
| EP | 0621056 | | 10/1994 | |
| EP | 2913083 | A1 * | 9/2015 | A62B 18/025 |
| EP | 3446755 | | 2/2019 | |
| EP | 3446756 | | 2/2019 | |
| JP | 3039303 | | 7/1997 | |
| JP | H10165527 | | 6/1998 | |
| JP | 3117209 | U | 1/2006 | |
| JP | 2011078604 | | 4/2011 | |
| JP | 2011115449 | | 6/2011 | |
| JP | 2012-075793 | | 4/2012 | |
| JP | 2015-524337 | | 8/2015 | |
| JP | 2016087376 | | 5/2016 | |
| JP | 2018000982 | | 1/2018 | |
| JP | 2018033905 | | 3/2018 | |
| JP | 2018089158 | | 6/2018 | |
| JP | 2019501721 | | 1/2019 | |
| KR | 10-1995-0008732 | | 8/1995 | |
| KR | 20050061384 | | 6/2005 | |
| KR | 20100081991 | | 7/2010 | |
| KR | 20-2010-0009804 | | 10/2010 | |
| KR | 200461294 | | 7/2012 | |
| KR | 101536265 | | 7/2015 | |
| KR | 101619487 | | 5/2016 | |
| KR | 20160062808 | | 6/2016 | |
| KR | 101788685 | | 10/2017 | |
| KR | 20170111132 | | 10/2017 | |
| KR | 20170126163 | | 11/2017 | |
| KR | 1020180027561 | | 3/2018 | |
| KR | 20180064284 | | 6/2018 | |
| KR | 20180128040 | | 11/2018 | |
| KR | 101925388 | | 12/2018 | |
| KR | 1020190033299 | | 3/2019 | |
| KR | 10-2019-0022668 | | 6/2019 | |
| KR | 102002878 | | 7/2019 | |
| KR | 101997813 | | 10/2019 | |
| KR | 1020200033495 | | 3/2020 | |
| KR | 102110687 | | 5/2020 | |
| KR | 1020200048502 | | 5/2020 | |
| KR | 1020200049490 | | 5/2020 | |
| KR | 1020200079925 | | 7/2020 | |
| TW | 201201879 | | 1/2012 | |
| TW | M555232 | | 2/2018 | |
| WO | WO2009067583 | | 5/2009 | |
| WO | WO2010070495 | | 6/2010 | |
| WO | WO2014020469 | | 2/2014 | |
| WO | WO 2016/072868 | | 5/2016 | |
| WO | WO2016157159 | | 10/2016 | |
| WO | WO20170004313 | | 1/2017 | |
| WO | WO2017116174 | | 7/2017 | |
| WO | WO2018036902 | | 3/2018 | |
| WO | WO2018147941 | | 8/2018 | |
| WO | WO2020055106 | | 3/2020 | |
| WO | WO2020094850 | | 5/2020 | |

OTHER PUBLICATIONS

Korean Office Action in Korean Appln. No. 2020-0068404, dated Apr. 5, 2021, 11 pages (with English translation).
Korean Office Action in Korean Appln. No. 2020-0068407, dated Apr. 5, 2021, 11 pages (with English translation).
Korean Office Action in Korean Appln. No. 2020-0068611, dated Apr. 5, 2021, 11 pages (with English translation).
Korean Office Action in Korean Appln. No. 2020-0109160, dated Feb. 11, 2021, 21 pages (with English translation).
Extended European Search Report in European Appln. No. 20217535.2, dated Jun. 22, 2021, 4 pages.
Extended European Search Report in European Appln. No.20217537.8, dated Jun. 22, 2021, 4 pages.
Office Action in Korean Appln. No. 10-2020-0068404, dated Jun. 30, 2021, 12 pages (with English translation).
Office Action in Korean Appln. No. 10-2020-0068611, dated Jun. 30, 2021, 12 pages (with English translation).
Office Action in Taiwanese Appln. No. 109146705, dated Jul. 7, 2021, 19 pages (with English translation).
Office Action in Taiwanese Appln. No. 110102539, dated Jul. 12, 2021, 10 pages (with English translation).
Office Action in Taiwanese Appln. No. 110102540, dated Jul. 12, 2021, 19 pages (with English translation).
Extended European Search Report in European Appln. No. 21169773.5, dated Sep. 24, 2021, 4 pages.
Extended European Search Report in European Appln. No. 21169777.6, dated Sep. 24, 2021, 5 pages.
Office Action in Japanese Appln. No. 2020-204668, dated Feb. 7, 2022, 12 pages (with English translation).
Office Action in Korean Appln. No. 10-2020-0080437, dated Feb. 21, 2022, 13 pages (with English translation).
Office Action in Korean Appln. No. 10-2020-0068421, dated Jan. 23, 2022, 12 pages (with English translation).
Office Action in Taiwanese Appln. No. 11120021940, dated Dec. 20, 2020, 11 pages (with English translation).
Notice of Allowance in Korean Appln. No. 10-2020-0068407, dated Nov. 29, 2021, 4 pages (with English translation).
Office Action in Korean Appln. No. 10-2020-0068400, dated Dec. 27, 2021, 13 pages (with English translation).
Office Action in Korean Appln. No. 10-2020-0068412, dated Dec. 27, 2021, 15 pages (with English translation).
Office Action in Korean Appln. No. 10-2020-0080417, dated Dec. 28, 2021, 13 pages (with English translation).

(56) References Cited

OTHER PUBLICATIONS

Office Action in Korean Appln. No. 10-2020-0089132, dated Dec. 28, 2021, 13 pages (with English translation).
Office Action in Korean Appln. No. 10-2020-0068413, dated Nov. 17, 2021, 13 pages (with English translation).
Office Action in Korean Appln. No. 10-2020-0080087, dated Nov. 30, 2021, 15 pages (with English translation).
Office Action in Indian Appln. No. 202114007027, dated Jan. 5, 2022, 6 pages.
Office Action in Indian Appln. No. 202114003123, dated Jan. 6, 2022, 5 pages.
Office Action in Indian Appln. No. 202114008985, dated Jan. 12, 2022, 5 pages.
Office Action in Indian Appln. No. 202114003125, dated Jan. 13, 2022, 5 pages.
Office Action in Indian Appln. No. 202114007372, dated Jan. 24, 2022, 6 pages.
Extended European Search Report in European Appln. No. 21169778.4, dated Oct. 15, 2021, 5 pages.
Extended European Search Report in European Appln. No. 21169793.3, dated Oct. 15, 2021, 4 pages.
Extended European Search Report in European Appln. No. 21169796.6, dated Oct. 18, 2021, 4 pages.
Extended European Search Report in European Appln. No. 21169813.9, dated Oct. 20, 2021, 4 pages.
Extended European Search Report in European Appln. No. 21169817.0, dated Oct. 14, 2021, 4 pages.
Extended European Search Report in European Appln. No. 21170476.2, dated Oct. 13, 2021, 4 pages.
Extended European Search Report in European Appln. No. 21170861.5, dated Oct. 25, 2021, 4 pages.
Decision to Grant a Patent in Japanese Appln. No. 2021-043251, dated Oct. 25, 2022, 5 pages (with English translation).
Office Action in European Appln. No. 20217533.7, dated Nov. 23, 2022, 5 pages.
Office Action in European Appln. No. 21182279.6, dated Oct. 17, 2022, 2 pages.
Office Action in Taiwanese Appln. No. 110117972, dated Oct. 7, 2022, 14 pages (with English translation).
Written Decision on Registration in Korean Appln. No. 10-2020-0080437, dated Oct. 22, 2022, 11 pages (with English translation).
Notice of Allowance in Japanese Appln. No. 2020-204668, dated Aug. 16, 2022, 5 pages (with English translation).
Office Action in Chinese Appln. No. 202110552518.6, dated Jul. 4, 2022, 18 pages (with English translation).
Office Action in Chinese Appln. No. 202011089763, dated Feb. 11, 2023, 18 pages (with English translation).
Office Action in Chinese Appln. No. 202011328031, dated Feb. 15, 2023, 18 pages (with English translation).
Office Action in Korean Appln. No. 20210129533, dated Mar. 28, 2023, 18 pages (with English translation).
Office Action in Korean Appln. No. 20220126062, dated Mar. 23, 2023, 23 pages (with English translation).
Office Action in Chinese Appln. No. 202011403700.7, dated May 4, 2023, 18 pages (with English translation).

* cited by examiner

MASK APPARATUS

CROSS-REFERENCE TO RELATED APPLICATIONS

The present application claims the benefit of priority to Korean Patent Application No. 10-2020-0068421, filed on Jun. 5, 2020, the disclosure of which is incorporated herein by reference in its entirety.

TECHNICAL FIELD

The present disclosure relates to a mask apparatus.

BACKGROUND

A mask is a device that can cover a user's nose and mouth to reduce or prevent inhalation of germs and dust or droplet transmitting viruses or bacteria. The mask can be in close contact with the user's face to cover the user's nose and mouth. The mask can filter germs, dust, and the like, which may be contained in the air and provide the filtered air to the user's mouth and nose. Air containing germs and dust may pass through a body of the mask including a filter configured to block the germs and the dust.

In some cases, a mask can include a hook portion that is hooked and fixed to a wearer's ear or neck to allow the mask to be in close contact with the wearer's face.

For example, the mask may include a mask body covering a wearer's face, an ear hook portion provided at both left and right sides of a side surface of the mask body so as to be hooked on the wearer's ear, and a length adjustment member that adjusts a length of the ear hook portion.

In some cases, the length adjustment member can include a ring portion provided at the side surface of the mask body and a length adjustment portion that pulls a portion, which is hooked on the wearer's ear, of the ear hook portion to adjust a length of the portion, which is hooked on the wearer's ear.

One end of the strap of the ear hook portion may be fixed to an edge of the side surface of the mask body, and the other end of the strap may pass through the inside of the ring portion and then be fixed to the edge of the side surface of the mask body.

In some cases, the length adjustment portion may be a portion of the ear hook portion disposed between the ring portion and the other end fixed to the edge of the side surface of the mask body so as to be always exposed to the outside. Thus, when the length adjustment portion is pulled in a state in which the ear hook portion is inserted into the wearer's ear, since the length of the ear hook portion is reduced by a length of the length adjustment portion, which is drawn by passing through the ring portion, the length of the length adjustment portion may match the wearer's ear.

In some cases, the adjusted strap length may not be maintained for a long time when the wearer adjusts the strap of the mask to mount the mask. In some cases, when the wearer talks or breathes for a long time, the mask strap may be loosened, and the mask may be separated from the wearer's face.

In some cases, where the string length adjustment portion is fixed to the one side of the mask body and is not separated, it may be difficult to clean the mask when the mask is contaminated by the wearer's sweat or cosmetics.

SUMMARY

The present disclosure describes a mask apparatus including an ear hook portion that can be easily attached and detached.

The present disclosure also describes a mask apparatus including an ear hook portion that can be effectively prevented from being separated when the mask apparatus is used.

The present disclosure also describes a mask apparatus including a strap of an ear hook portion that can be easily adjusted in length.

The present disclosure also describes a mask apparatus including ear hook portions that can help a user to avoid an erroneous assembly or confusion between the ear hook portions.

The present disclosure further describes a mask apparatus that can be used for a long time without sliding of the mask apparatus from the user.

According to one aspect of the subject matter described in this application, a mask apparatus includes a mask body, a pair of hook mounting portions that are disposed at side ends of the mask body, respectively, a mask body cover coupled to a front surface of the mask body, a seal coupled to a rear surface of the mask body and configured to define a breathing space therein, and a pair of ear hook portions that are configured to be connected to the pair of hook mounting portions, respectively. Each of the pair of hook mounting portions includes an upper hook mounting portion disposed at one of the side ends of the mask body, a lower hook mounting portion disposed at the one of the side ends of the mask body and positioned vertically below the upper hook mounting portion, a hook pin disposed at each of the upper hook mounting portion and the lower hook mounting portion, and a through-hole defined in each of the upper hook mounting portion and the lower hook mounting portion. Each of the pair of ear hook portions includes a strap portion, a first hook portion configured to connect a first end of the strap portion to one of the upper hook mounting portion or the lower hook mounting portion, and a second hook portion configured to connect a second end of the strap portion to the other of the upper hook mounting portion or the lower hook mounting portion.

Implementations according to this aspect can include one or more of the following features. For example, each of the first hook portion and the second hook portion can include a hook body having a cylindrical shape, the hook body being configured to be coupled to the hook pin, and a hook extension portion that extends from an outer circumferential surface of the hook body. In some examples, the hook body can include a hook groove configured to receive the hook pin, and a guide opening that is recessed from the outer circumferential surface of the hook body configured to guide the hook pin to the hook groove.

In some examples, a first width of the guide opening at the hook groove is less than a second width of the guide opening at the outer circumferential surface of the hook body. In some examples, at least a portion of the hook body is configured to be accommodated in the through-hole. In some examples, a width of the through-hole corresponds to an outer diameter of the hook body, and a length of the through-hole corresponds to a length of the hook body.

In some implementations, the hook pin can be configured to be inserted into the hook groove in a first direction, where the hook extension portion extends in a second direction intersecting the first direction. In some examples, an angle defined between the first direction and the second direction is less than or equal to 90 degrees.

In some implementations, the hook extension portion can define one or more hook through-holes configured to receive the first end or the second end of the strap portion. In some examples, each of the pair of ear hook portions can include a first band configured to couple the first end of the strap portion to a body portion of the strap portion, where the first end of the strap portion passes through the one or more hook through-holes. In some examples, each of the pair of ear hook portions can further include a second band configured to receive the second end of the strap portion.

In some implementations, the mask apparatus can include a length adjustment portion member configured to adjust a length of the strap portion disposed around an ear of a user. For example, the length adjustment portion member can include an opening configured to allow the second end of the strap portion and the body portion of the strap portion to pass therethrough.

In some implementations, the hook extension portion of the first hook portion can define one hook through-hole among the one or more hook through-holes, and the hook extension portion of the second hook portion can define two hook through-holes among the one or more hook through-holes. In some examples, the first band can be configured to couple the first end of the strap portion, which passes through the one hook through-hole, to the body portion of the strap portion.

In some examples, each of the pair of ear hook portions further can include a second band configured to receive the second end of the strap portion that passes through the two hook through-holes.

In some implementations, the mask apparatus can include a neck band configured to connect the pair of ear hook portions to each other. In some examples, the neck band includes a band body, and a pair of hooking portions that are bent from ends of the band body and extend toward each other. In some examples, the neck band can further include a hook protrusion that protrudes from an end of each of the pair of hooking portions.

In some implementations, the through-hole can be configured to communicate air with an inner space defined between the mask body and the mask body cover and to decrease a temperature in the inner space. In some examples, each of the first hook portion and the second hook portion can be configured to, based on a user wearing the mask apparatus, block at least a portion of the through-hole.

In some implementations, the ear hook portion can be hung on the wearer's ear and can be easily attached and detached to the mask body, and the mask apparatus can be easily cleaned.

In some implementations, in the state in which the mask apparatus is worn, the hook pin can restrict separation of the hook portion of the ear hook portion from the hook pin, and the mask apparatus can be stably worn.

In some implementations, the length of the strap portion can be easily adjusted through the length adjustment portion, which can improve the convenience of use.

In some implementations, the plurality of hook portions of the ear hook portions can have different shapes such that a user can avoid an erroneous assembly or confusion between the ear hook portions.

In some implementations, the neck band can connect the ear hooks mounted on both the sides of the mask to each other, and the mask apparatus can be effectively prevented from being slid down.

DETAILED DESCRIPTION

Figure 1:
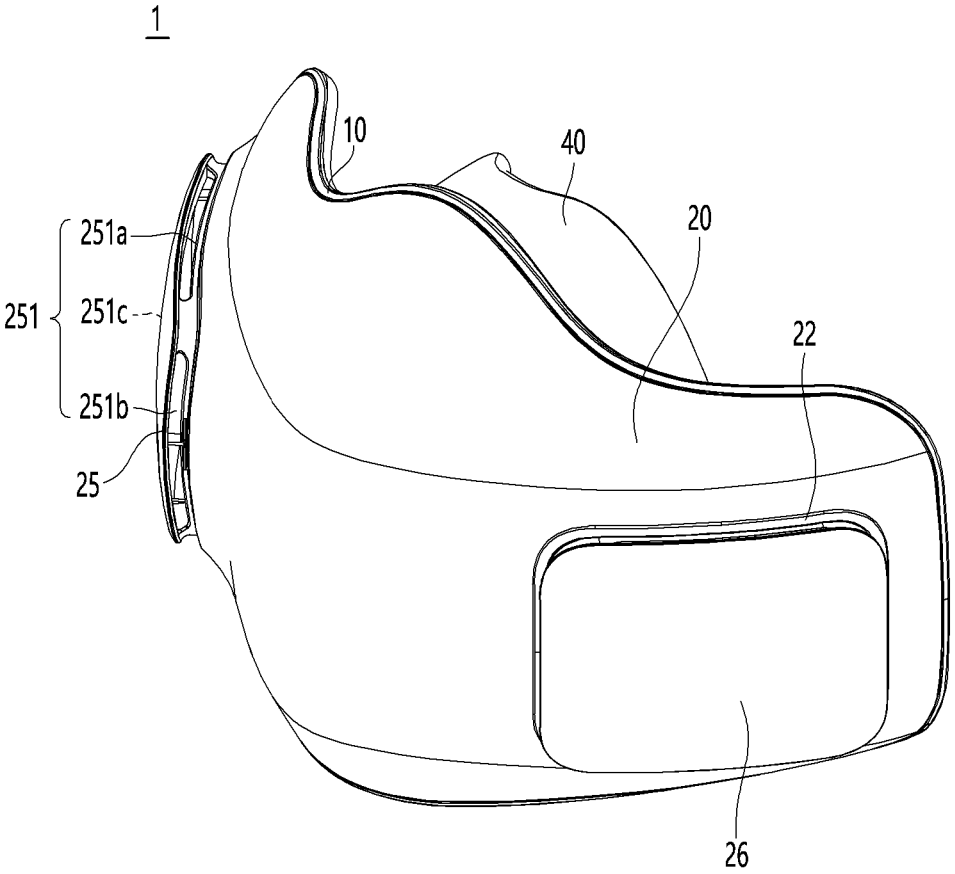
FIG. 1 is a left perspective view illustrating an example of a mask apparatus.
Figure 2:
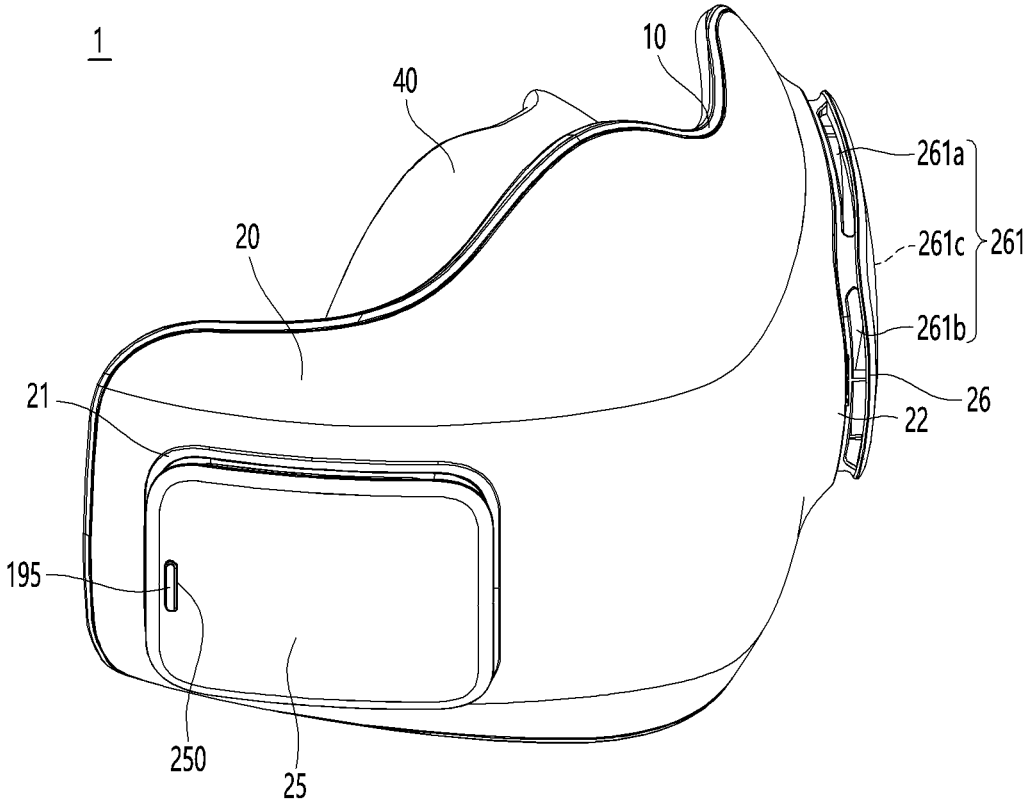
FIG. 2 is a right perspective view illustrating the mask apparatus.
Figure 3:
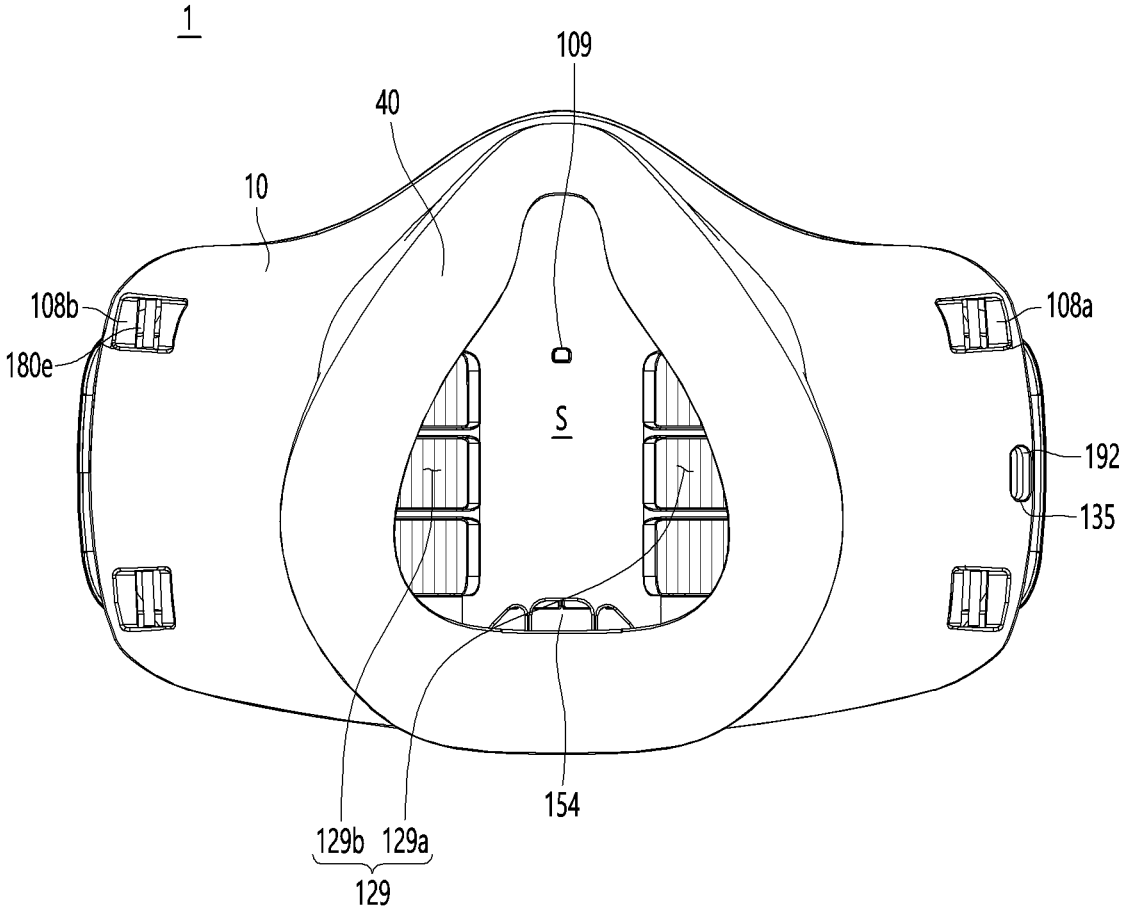
FIG. 3 is a rear view illustrating the mask apparatus.
Figure 4:
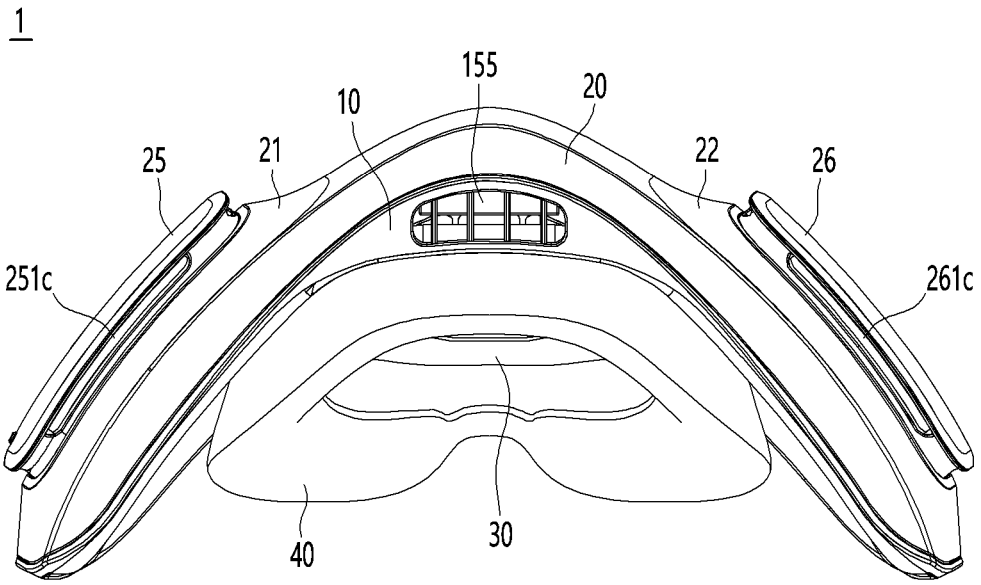
FIG. 4 is a bottom view illustrating the mask apparatus.

FIG. 1 is a left perspective view illustrating an example of a mask apparatus, FIG. 2 is a right perspective view illustrating the mask apparatus, FIG. 3 is a rear view illustrating the mask apparatus, and FIG. 4 is a bottom view illustrating the mask apparatus.

Referring to FIGS. 1 to 4, a mask apparatus 1 can include a mask body 10 and a mask body cover 20 coupled to the mask body 10.

The mask body 10 and the mask body cover 20 can be detachably coupled to each other. When the mask body 10 and the mask body cover 20 are coupled to each other, an inner space can be defined between the mask body 10 and the mask body cover 20. Constituents for driving the mask apparatus 1 can be disposed in the inner space. The inner space can be defined between a front surface of the mask body 10 and a rear surface of the mask body cover 20. The mask body 10 can define a rear surface of the mask apparatus 1, and the mask body cover 20 can define a front surface of the mask apparatus 1.

A rear side of the mask apparatus 1 is defined as a direction in which the rear surface of the mask apparatus 1 facing a user's face is disposed, and a front side of the mask apparatus 1 is defined as a direction which is opposite to the rear side and in which a front surface of the mask apparatus 1, which is exposed to the outside, is disposed.

The mask apparatus 1 can further include a sealing bracket 30 and a seal 40 that is detachably coupled to the sealing bracket 30.

The sealing bracket 30 can be detachably coupled to a rear surface of the mask body 10 to fix the seal 40 to the rear surface of the mask body 10. In some examples, when the sealing bracket 30 is separated from the rear surface of the mask body 10, the seal 40 can be separated from the mask body 10.

The seal 40 can be supported on the rear surface of the mask body 10 by the sealing bracket 30, and a breathing space S for breathing can be defined between the seal 40 and the rear surface of the mask body 10. The seal 40 can be in close contact with a user's face and can surround user's nose and mouth to restrict introduction of external air into the breathing space S.

The mask body cover 20 can include a first filter mounting portion 21 and a second filter mounting portion 22. The first filter mounting portion 21 can be disposed at a right side of the mask body cover 20, and the second filter mounting portion 22 can be disposed at a left side of the mask body cover 20.

A left direction (left side) and a right direction (right side) are defined based on the mask apparatus 1 worn on the user's face. That is, in the state in which the user wearing the mask apparatus 1, a right side of the user is defined as the right side of the mask apparatus 1, and a left side of the user is defined as the left side of the mask apparatus 1.

In some examples, an upward direction (upward side) and a downward direction (downward side) are defined based on the mask apparatus 1 mounted on the user's face.

A first filter cover 25 can be mounted on the first filter mounting portion 21, and a second filter cover 26 can be mounted on the second filter mounting portion 22. Filters 23 and (see FIG. 5) can be disposed inside the first filter mounting portion 21 and the second filter mounting portion 22, and the first filter cover 25 and the second filter cover 26 can cover the filter.

The first filter cover 25 and the second filter cover 26 can be detachably coupled to the first filter mounting portion 21 and the second filter mounting portion 22, respectively. For example, the first filter cover 25 and the second filter cover 26 can be coupled to be fitted into the first filter mounting portion 21 and the second filter mounting portion 22, respectively.

Each of the first filter cover 25 and the second filter cover 26 can include a front surface portion and side surface portions extending backward along an edge of the front surface portion or an edge of a rear surface.

Each of the side surface portions of the first filter cover 25 and the second filter cover 26 can have four side surfaces, and the four side surfaces can include an upper side surface, a lower side surface, a left side surface, and a right side surface.

One or a plurality of first air inlets 251 can be defined in the side surface portion of the first filter cover 25. One or a plurality of second air inlets 261 can also be defined in the side surface portion of the second filter cover 26.

In the state in which the first filter cover 25 is mounted on the first filter mounting portion 21, the first air inlet 251 can be defined to be exposed to the outside. In the state in which the second filter cover 26 is mounted on the second filter mounting portion 22, the second air inlet 261 can be defined to be exposed to the outside.

The first air inlet 251 and the second air inlet 261 can be defined in the side surfaces of the first filter cover 25 and the second filter cover 26, respectively.

In some implementations, each of the first and second air inlets 251 and 261 can be respectively defined in the front surface portions of the first and second filter covers 25 and 26.

The first air inlet 251 and the second air inlet 261 can be defined at a point closer to the front surface portion from a line that bisects the side surface portion.

When a plurality of the first air inlets 251 are provided in the side surface portions of the first filter cover 25, the first air inlets 251 can include a first air suction hole 251*a* defined in the right side surface, a second air suction hole 251*b* defined in the left side surface, and a third air suction hole 251*c* defined in the upper side surface.

Similarly, when a plurality of the second air inlets 261 are provided in the side surface portions of the second filter cover 26, the second air inlets 261 can include a first air suction hole 261*a* defined in the left side surface, a second air suction hole 261*b* defined in the right side surface, and a third air suction hole 261*c* defined in the upper side surface.

An opening 250 can be defined in one of the first filter cover 25 and the second filter cover 26, and the opening 250 can be defined in an edge of one of the first filter cover 25 and the second filter cover 26. In some examples, a manipulation portion 195 for controlling an operation of the mask apparatus 1 can be mounted in the opening 250. In some examples, the manipulation portion 195 is mounted on the first filter cover 25 as an example.

The manipulation portion 195 can serve as a manipulation switch that turns on/off power of the mask apparatus 1. The manipulation portion 195 can be exposed to the front side of the mask apparatus 1 while being mounted in the opening 250.

The mask body 10 can include a hook mounting portion 108. The hook mounting portion 108 can be provided on the left and right sides of the mask body 10. That is, the hook mounting portion 108 can include a first hook mounting portion 108*a* provided at a right side of the mask body 10, and a second hook mounting portion 108*b* provided at a left side of the mask body 10.

Each of the first hook mounting portion 108*a* and the second hook mounting portion 108*b* can be provided in plurality to be spaced apart from each other in a vertical direction of the mask body 10. In detail, the first hook mounting portion 108*a* can be provided at each of the upper right and lower right sides of the mask body 10, and the second hook mounting portion 108*b* can be provided at each of the upper left and lower left sides of the mask body 10.

Bands for maintaining the mask apparatus 1 in close contact with the user's face can be coupled to the hook mounting portion 108.

For example, both ends of each of the bands can connect the first hook mounting portion 108*a* to the second hook mounting portion 108*b*, or two bands can respectively connect two first hook mounting portions 108*a* spaced apart from each other in the vertical direction to two second hook mounting portions 108*b* spaced apart from each other in the vertical direction to each other.

In the former case, the band can have a shape surrounding the user's occipital region, and in the latter case, the band can have a shape that is hooked on both ears of the user.

The hook mounting portion 108 can be formed by cutting a portion of the mask body 10. Thus, air can be introduced into the inner space between the mask body 10 and the mask body cover through a through-hole 108*e* defined in the hook mounting portion 108.

In some examples, the external air introduced into the inner space through the hook mounting portion 108 can cool electronic components disposed in the inner space. In some examples, the air of which a temperature increases while cooling the electronic components can be discharged again to the outside of the mask body 10 through the through-hole 108*e* of the hook mounting portion 108. In some examples, to restrict a flow of the air introduced into the inner space through the through-hole 108*e* of the hook mounting portion 108 into the breathing space, the inside of the mask apparatus 1 can have a sealing structure.

The mask body 10 can include an air outlet 129 for supplying the filtered air to the breathing space. The user can breathe while breathing the filtered air supplied through the air outlet 129 to the breathing space.

The air outlet 129 can include a first air outlet 129*a* through which the filtered air introduced into the first air inlet 251 is discharged to the breathing space S and a second air outlet 129*b* through which the filtered air introduced into the second air inlet 261 is discharged to the breathing space S.

The first air outlet 129*a* can be defined at a right side with respect to a center of the mask body 10, and the second air outlet 129*b* can be defined at a left side with respect to the center of the mask body 10. The air introduced through the first air inlet 251 can pass through the filter 23 and then flow to the first air outlet 129*a*. The air introduced through the second air inlet 261 can pass through the filter 24 and then flow to the second air outlet 129*b*.

The mask body 10 can include air exhaust holes 154 and 155 for discharging air exhaled by the user to an external space. The air exhaust holes 154 and 155 can be defined in a lower portion the mask body 10.

The air exhaust holes 154 and 155 can include a first air exhaust hole 154 defined in a front lower end of the mask body 10 and a second air exhaust hole 155 defined in a bottom surface of the mask body 10.

In detail, a rib extending forward can be formed at the front lower end of the mask body 10, and a surface defined by the rib can be defined as the bottom surface of the mask body 10.

A flow space through the air flowing toward the second air exhaust hole 155 by passing through the first air exhaust hole 154 descends can be defined between the mask body 10 and the mask body cover 20.

A check valve can be provided in one or more of the first air exhaust hole 154 and the second air exhaust hole 155. The external air can be introduced into the breathing space, or the air discharged through the second air exhaust hole 155 can be prevented from flow backward by the check valve. The check valve can be disposed in the flow space between the first air exhaust hole 154 to the second air exhaust hole 155.

For example, the check valve having the form of a flat flap with a size and shape corresponding to the size and shape of the first air exhaust hole 154 can be provided.

In some implementations, an upper end of the flap can be connected to an upper edge of the first air exhaust hole 154, and when the user exhales, the flap can be bent or rotates to open the first air exhaust hole 154, and when the user inhales, the flap can be in close contact with the first air exhaust hole 154 to prevent the external air or the discharged air from being introduced again into the breathing space.

The mask body 10 can include a sensor mounting portion 109. The sensor mounting portion 109 can be equipped with a sensor for acquiring various pieces of information from the breathing space. The sensor mounting portion 109 can be disposed above the mask body 10. When the user breathes, the sensor mounting portion 109 can be disposed above the mask body 10 in consideration of a position at which a pressure change in the breathing space is constantly sensed.

The mask body 10 can include a connector hole 135. In some examples, the connector hole 135 can include an opening configured to receive a connector for supplying power to the mask apparatus 1. The connector hole 135 can be defined at either a left edge or a right edge of the mask body 10.

In some examples, since the manipulation portion 195 and the connector are connected to a power module 19 (see FIG. 5) to be described later, the connector hole 135 can be provided at one side of the left or the right side of the mask body 10, which corresponds to the position at which the power module 19 is installed.

Hereinafter, constituents of the mask apparatus 1 will be described in detail based on an exploded perspective view.

Figure 5:
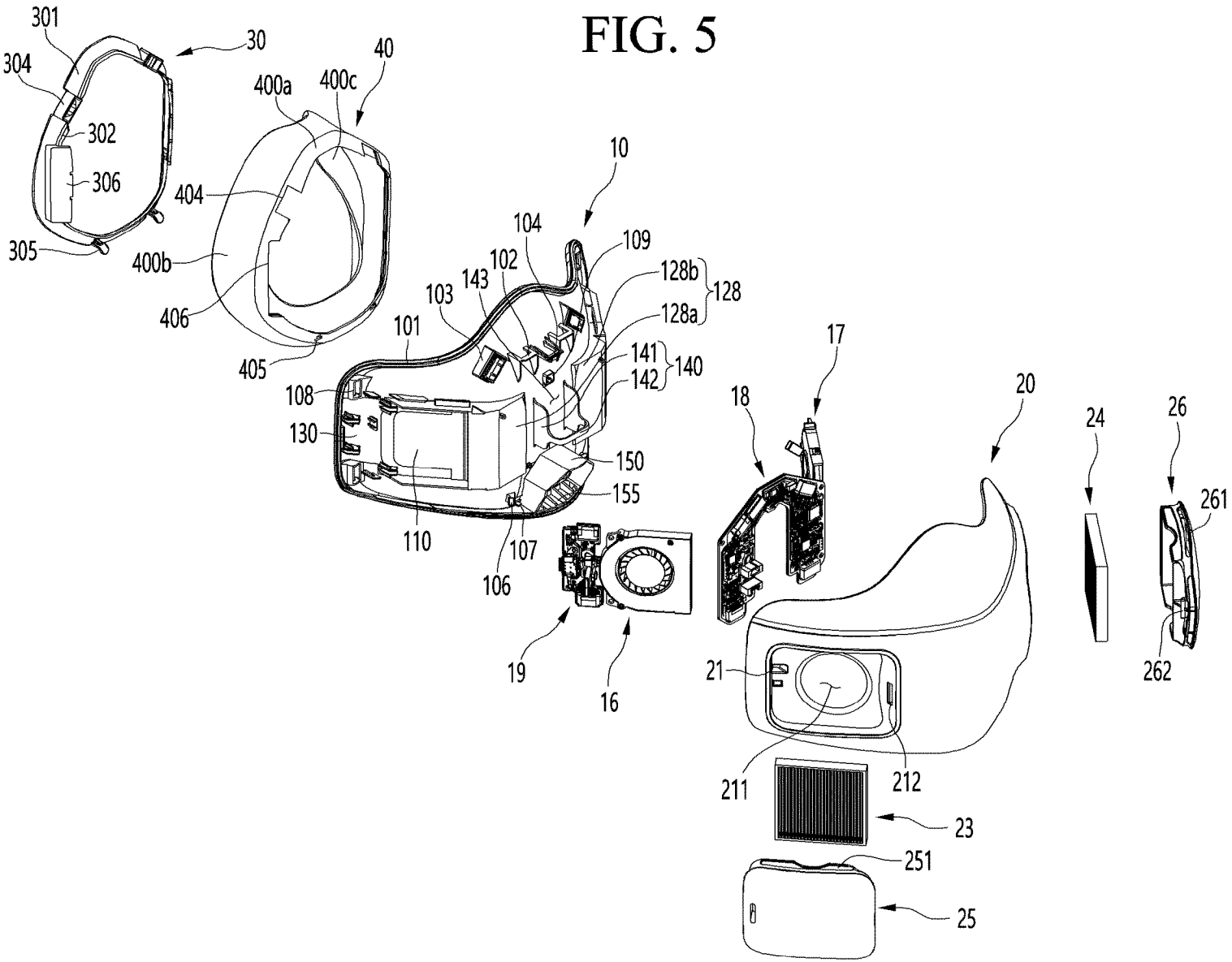
FIG. 5 is an exploded perspective view illustrating the mask apparatus.

FIG. 5 is an exploded perspective view of the mask apparatus.

Referring to FIG. 5, the mask apparatus 1 can include the mask body 10, the mask body cover 20, the sealing bracket 30, and the seal 40.

In some examples, the mask body 10 and the mask body cover 20 can be coupled to each other to form an outer appearance of the mask apparatus 1.

An inner space for accommodating components for the operation of the mask apparatus 1 can be defined between the mask body 10 and the mask body cover 20. The sealing bracket 30 and the seal 40 are coupled to the rear surface of the mask body 10 to define the breathing space between the user's face and the mask body 10 and prevent the external air from being introduced into the breathing space.

The mask body 10 can include a cover coupling groove 101. The cover coupling groove 101 can be defined along a front edge of the mask body 10. The cover coupling groove 101 can be defined by a height difference. The cover coupling groove 101 can be defined to correspond to an edge of the mask body cover 20. The cover coupling groove 101 can be defined by recessing a portion of the front surface of the mask body 10 backward. The mask body cover 20 can move toward the cover coupling groove 101 of the mask body 10 to allow the mask body cover 20 to be inserted into the cover coupling groove 101.

The mask body 10 can include a first cover coupling portion 102. An upper portion of the mask body cover 20 can be supported on the first cover coupling portion 102. The first cover coupling portion 102 can be disposed on a front upper portion of the mask body 10.

For example, the first cover coupling portion 102 can have a structure that is capable of being hook-coupled. The hook coupled to the first cover coupling portion 102 can be disposed on a rear surface of the mask body cover 20.

The first cover coupling portion 102 can be provided in plurality, and the hook can also be provided in plurality to correspond to the first cover coupling portions 102. In some examples, the first cover coupling portion 102 can be provided at the left and right sides with respect to the center of the mask body 10, respectively. The first cover coupling portion 102 can be referred to as an upper cover coupling portion.

The mask body 10 can include a first bracket coupling portion 103. The first bracket coupling portion 103 can be disposed above the mask body 10. The first bracket coupling portion 103 can support an upper portion of the sealing bracket 30.

The first bracket coupling portion 103 can be disposed above a rear surface of the mask body 10.

For example, the first bracket coupling portion 103 can be provided by allowing a portion constituting the mask body 10 to protrude forward from the rear surface of the mask body 10. Thus, the first bracket coupling portion 103 can be understood as a recess when viewed from a rear side of the mask body 10 and a protrusion when viewed from a front side of the mask body 10.

The sealing bracket 30 can include a first body coupling portion 304 that has the same shape as the recessed shape of the first bracket coupling portion 103 and is seated on the first bracket coupling portion 103.

The first bracket coupling portion 103 can be provided at each of the left and right sides of the mask body 10. The first bracket coupling portion 103 can be defined as an upper bracket coupling portion.

The mask body 10 can include a support rib 104.

The support rib 104 can be provided to protrude forward from the front surface of the mask body 10. The support rib 104 can contact the rear surface of the mask body cover 20 when the mask body cover 20 is coupled to the mask body 10.

The mask body 10 and the mask body cover 20 can resist external forces acting in a front and rear direction by the support rib 104. The support ribs 104 can be provided in plurality on the front surface of the mask body 10.

The support rib 104 can perform a function of fixing a portion of the control module 18 mounted on the mask body 10. For this, the support rib 104 can include a hook shape. In other words, a hook protrusion can protrude from an end of the support rib 104 to fix the end of the control module 18.

In some examples, the control module 18 can include a controller, an electric circuit, one or more processors, or the like, that can control operation of components of the mask apparatus 1 such as the pressure sensor and the fan modules 16 and 17.

The mask body 10 can include a second cover coupling portion 106.

A lower portion of the mask body cover 20 can be supported on the second cover coupling portion 106. The second cover coupling portion 106 can protrude in a hook shape from a front lower end of the mask body 10. The first cover coupling portion 106 can be provided at each of the left and right sides from the center of the mask body 10. The second cover coupling portion 106 can be defined as a lower cover coupling portion.

A hook catching portion to which the second cover coupling portion 106 is coupled can be disposed on the mask body cover 20, and the hook catching portion can be disposed at each of left and right sides of the mask body cover 20.

The mask body 10 can include a second bracket coupling portion 107. A lower portion of the sealing bracket 30 can be supported on the second bracket coupling portion 107. The second bracket coupling portion 107 can be provided by opening the mask body 10. The second bracket coupling portion 107 can be disposed in a lower portion of the mask body 10. For example, the second bracket coupling portion 107 can be provided as a through-hole defined in the mask body 10.

A second body coupling portion 305 coupled to the second bracket coupling portion 107 can be disposed on the sealing bracket 30. The second bracket coupling portion 107 can be provided in plurality, and the second body coupling portion 305 can also be provided in plurality to correspond to the second bracket coupling portions 107. In some examples, the second bracket coupling portion 107 can be provided at each of the left and right sides with respect to the center of the mask body 10. The second bracket coupling portion 107 can be defined as a lower bracket coupling portion.

The mask body 10 can include the above-described sensor mounting portion 109.

The sensor mounting portion 109 can have a rib shape in which a portion of the front surface of the mask body 10 protrudes forward. In detail, the sensor mounting portion 109 has a rib shape that is surrounded along an edge of the sensor, and an installation space in which the sensor is installed is defined in the sensor mounting portion 109.

A hole through which the installation space and the breathing space communicate with each other is defined in the mask body 10 corresponding to the inside of the sensor mounting portion 109. The sensor disposed in the installation space can include a pressure sensor, and the pressure sensor can sense pressure information of the breathing space through the hole.

The mask body 10 can include a fan module mounting portion 110.

The fan module mounting portion 110 can include a first fan module mounting portion on which a first fan module 16 is mounted and a second fan module mounting portion on which a second fan module 17 is mounted.

The first fan module mounting portion and the second fan module mounting portion can be disposed on the front surface of the mask body 10. In detail, the first fan module mounting portion can be disposed at the right side of the mask body 10, and the second fan module mounting portion can be disposed at the left side of the mask body 10.

The first fan module 16 and the second fan module 17 can be detachably coupled to the first fan module mounting portion and the second fan module mounting portion, respectively.

The mask body 10 can include an air duct 120.

The air duct 120 can be disposed on the front surface of the mask body 10. A passage through which air passes can be provided in the air duct 120.

The air duct 120 can include a first air duct connected to the first fan module mounting portion and a second air duct connected to the second fan module mounting portion.

The first air duct and the second air duct can be disposed on an edge of the first fan module mounting portion and an edge of the second fan module mounting portion, which are adjacent to the center of the front surface of the mask body 10 so as to be disposed between the first fan module mounting portion and the second fan module mounting portion.

In some examples, the first fan module mounting portion and the second fan module mounting portion can have a shape symmetrical with respect to a vertical plane (or a vertical line) passing through the center of the front surface of the mask body 10. Similarly, the first air duct and the second air duct can also have a shape symmetrical with respect to the vertical plane or the vertical line passing through the center of the front surface of the mask body 10.

One end of the air duct 120 communicates with the outlets of the fan modules 16 and 17 to allow the external air to be introduced into the air duct 120. In addition, the other end of the air duct 120 communicates with the air outlet 129 so that the air introduced into the air duct 120 is discharged into the breathing space S.

A control module 18 can be mounted on the front surface of the air duct 120.

A control module mounting portion 128 for mounting the control module 18 can be disposed on the front surface of the air duct 120. A portion of the front surface of the air duct 120 can be provided as a flat portion on which the control module 18 is capable of being seated, and the flat portion can be defined as the control module mounting portion 128.

The control module mounting portion 128 can include a first control module mounting portion **128*a* provided in the first air duct and a second control module mounting portion 128*b* provided in the second air duct. One control module 18 can be fixed to the first control module mounting portion 128*a* and the second control module mounting portion 128*b*, or a plurality of control modules can be respectively fixed to the first and second control module mounting portions 128*a* and 128*b***.

The mask body 10 can include a power module mounting portion 130 for mounting the power module 19.

The power module mounting portion 130 can be disposed on the front surface of the mask body 10. The power module mounting portion 130 can be provided at one of the left and the right side of the mask body 10.

The power module mounting portion 130 can be disposed at the side of the fan module mounting portion 110. Specifically, the power module mounting portion 130 can be provided between the fan module mounting portion 110 and a side end of the mask body 10. The side end of the mask body 10 can be defined as an end adjacent to the user's ear when worn. In some examples, the connector hole 135 can be formed in the side end of the mask body 10, which is provided with the power module mounting portion 130.

The mask body 10 can include a battery mounting portion 140 for mounting a battery.

The battery mounting portion 140 can be disposed on the front surface of the mask body 10. The battery mounting portion 140 can be provided to protrude forward from the front surface of the mask body 10 so as to surround the battery.

For example, the battery mounting portion 140 can include a pair of guide ribs 141 protruding forward from the front surface of the mask body 10 and a connection rib 142 connecting front ends of the pair of guide ribs 141 to each other. In some examples, the battery can be mounted in a battery accommodation space defined by the pair of guide ribs 141 and the connection rib 142.

The battery can move downward from an upper side of the battery accommodating space and be inserted into the battery accommodating space and then can move in a reverse direction to be separated. A lower portion of the battery inserted into the battery mounting portion 140 can be supported by an air discharge portion 150 to be described later.

The mask body 10 can include the air discharge portion 150.

The air discharge portion 150 can be disposed in a lower portion of the mask body 10. The air discharge portion 150 can define a flow space through which the air flowing from the first air exhaust hole 154 toward the second air exhaust hole 155 passes.

The air discharge portion 150 can protrude forward from the front surface of the mask body 10. In some examples, the air discharge portion 150 can extend to be rounded in an arch shape or can extend to be bent several times.

When the mask body cover 20 is coupled to the mask body 10, a front end of the air discharge portion 150 can be in contact with the rear surface of the mask body cover 20, and the inner space of the mask body 10 and the flow space can be partitioned from each other. The air discharge portion 150 can define a top surface and both side surfaces of the flow space, and a rear surface of the mask body cover 20 can define a front surface of the flow space. In some examples, the front surface of the mask body 10 can define a rear surface of the flow space, and the bottom surface of the mask body 10 on which the second air exhaust hole 155 is defined can define a bottom surface of the flow space.

The top surface of the air discharge portion 150 can support a lower end of the battery. Both lower ends of the air discharge portion 150 having the arch shape or tunnel shape can be connected to the bottom surface of the mask body 10, and the bottom surface of the mask body 10 can be defined by the rib extending forward from the lower end of the front surface of the mask body 10. The cover coupling groove 101 is recessed along the front end of the rib defining the bottom surface of the mask body 10, and the lower end of the rear surface of the mask body cover 20 is coupled to the cover coupling groove 101.

The first air exhaust hole 154 can be defined in the front surface of the mask body 10 defining the rear surface of the flow space.

The mask body cover 20 can include a pair of filter mounting portions 21 and 22, as described above.

The filter mounting portions 21 and 22 can be provided by recessing the front surface of the mask body cover 20 by a predetermined depth toward the rear surface of the mask body cover 20. Filters 23 and 24 are accommodated inside the filter mounting portions 21 and 22, and filter covers 25 and 26 can be mounted on edges of the filter mounting portions 21 and 22 in the state in which the filters 23 and 24 are accommodated.

Air suction holes 211 may be defined in the filter mounting portions 21 and 22. The air suction holes 211 may communicate with suction holes defined in the front surfaces of the fan modules 16 and 17, respectively. Each of edges of the air suction holes 211 may have an inclined surface that inclined in a direction in which a diameter gradually decreases from the front surface to the rear surface.

A filter cover mounting groove 212 for fixing each of the filter covers 25 and 26 can be defined in a side surface of each of the filter mounting portions 21 and 22. A coupling protrusion inserted into the filter cover mounting groove 212 and 222 can be disposed on each of the filter covers 25 and 26. In FIG. 5, only the coupling protrusion 262 disposed on the left filter cover 26 is illustrated, but it is noted that the same coupling protrusion is disposed on the right filter cover 25 as well. A sealing material for sealing can be provided between the edges of the rear surfaces of the air suction holes 211 and 221 of the filter mounting portions 21 and 22 and the fan inlets of the fan modules 16 and 17. The sealing material can surround the air suction holes 211 and 221 and edges of the fan inlets of the fan modules 16 and 17 to prevent the external air from being introduced.

The filter mounting portions 21 and 22 include a first filter mounting portion 21 provided at the right side of the mask body cover 20 and a second filter mounting portion 22 provided at the left side of the mask body cover 20.

The air suction hole defined in the first filter mounting portion 21 can be defined as a first air suction hole 211, and the air suction hole defined in the second filter mounting portion 22 can be defined as a second air suction hole 221.

The filters 23 and 24 can include a first filter 23 accommodated inside the first filter mounting portion 21 and a second filter 24 accommodated inside the second filter mounting portion 22.

The filter covers 25 and 26 can include a first filter cover 25 mounted on the first filter mounting portion 21 and a second filter cover 26 mounted on the second filter mounting portion 22. A plurality of first air inlets 251 can be defined in the first filter cover 25 to allow the external air to be introduced, and a plurality of second air inlets 261 can be defined in the second filter cover 26 to allow the external air to be introduced.

The control module 18 can be referred to as a first electronic circuit component, and the power module 19 can be referred to as a second electronic circuit component.

The fan modules 16 and 17 can include a fan, a fan motor, and a fan housing accommodating the fan and the fan motor. The fan housing can include a suction hole through which the external air is introduced into the fan, and a discharge hole through which the air forcedly flowing by the fan is discharged.

The fan can include various types of fans. For example, the fan can include a centrifugal fan that suctions air from the front side of the mask body cover 20 and discharges the air to the side of the mask body 10. In some examples, the fan can include an axial fan or a cross flow fan.

The air introduced through the first air inlet 251 to pass through the first filter 23 is suctioned through the first air suction hole 211. In some examples, the air introduced through the second air inlet 261 to pass through the second filter 24 is suctioned through the second air suction hole 221.

The fan outlet of the first fan module 16 can communicate with the first air duct to discharge the air to the breathing space, and the fan outlet of the second fan module 17 can communicate with the second air duct to discharge the air to the breathing space.

The control module 18 can control an operation of the mask apparatus 1. The control module 18 can be fixed to the control module mounting portion 128.

The control module 18 can include a communication module to transmit and receive various types of information. The control module 18 can include a data storage module to store various types of information.

The control module 18 can control an operation of each of the fan modules 16 and 17. In detail, the control module 18 can control the operation of each of the fan modules 16 and 17 based on information sensed from the sensor.

The control module 18 can be electrically connected to the power module 19, the fan modules 16 and 17, and the battery so as to be interlocked with each other.

The power module 19 can receive power from the outside. The power module 19 can include a charging circuit for charging the battery. The power module 19 can include the connector 192 and the manipulation portion 195. Thus, the control module 18 can be operated by receiving battery power or external power through the connector 192.

The power module 19 can control supply of power to the mask apparatus 1 by the manipulation portion 195. In detail, the power module 19 can control supply of power from the battery to the control module 18 and the fan modules 16 and 17.

The seal 40 can be coupled to the rear surface of the mask body 10 by the sealing bracket 30 to be in close contact with the user's face.

The rear surface of the mask body 10 can be to be spaced apart from the user's face by the seal 40.

The sealing bracket 30 can be provided in a ring shape forming a closed loop. The seal 40 can be detachably coupled to the sealing bracket 30.

In some implementations, the sealing bracket 30 can be coupled to be detachable from the mask body 10 to separate the sealing bracket 30 from the mask body 10. With this structure, only the sealing bracket 30 can be separated, or an assembly of the seal 40 and the sealing bracket 30 can be separated from the mask body 10 to clean only sealing bracket 30 or clean both the sealing bracket 30 and the seal 40.

After the seal 40 is coupled to the sealing bracket 30, the sealing bracket 30 is coupled to the mask body 10, then the seal 40 is stably fixed to the mask body 10.

The sealing bracket 30 can include a sealing insertion portion 301 inserted into an inner edge of the seal 40.

The inner edge of the seal 40 can be provided in a shape of seal lips that is branched into two portions, and the sealing insertion portion 301 can be inserted into the seal lips.

The sealing insertion portion 301 can have a cross-sectional shape having a constant thickness or a cross-sectional shape of which a thickness decreases from an inner edge toward an outer edge. A body of the sealing bracket 30 can be provided by the sealing insertion portion 301 and a fixing guide 302 to be described later.

The sealing bracket 30 can include the fixing guide 302.

The fixing guide 302 can be bent at an inner end of the sealing insertion portion 301. When the sealing insertion portion 301 is completely inserted into the seal lips of the seal 40, one of the two seal lips is in contact with the fixing guide 302. That is, when the inner edge of the seal 40 is in contact with the fixing guide 302, it can be understood that the seal 40 is completely coupled to the sealing bracket 30.

The sealing bracket 30 can include a bracket insertion portion 306 coupled to the mask body 10. The bracket insertion portion 306 is inserted into a cutoff portion defined in the rear surface of the mask body 10 to cover a portion of an edge of the cutoff portion. The cutoff portion can be understood as an opening communicating with the air duct 120 so that the air passes therethrough. The bracket insertion portion 306 can be disposed on one edge of the cutoff portion, specifically, an outer edge.

The air outlet 129 already described can be understood as the remaining portion of the cutoff portion that is not covered by the bracket insertion portion 306 in a state in which the bracket insertion portion 306 is inserted into one side of the cutoff portion.

When the bracket insertion portion 306 is inserted into or coupled to the one side of the cutoff portion to shield the one side of the cutoff portion, the air discharged from the fan modules 16 and 17 can pass between the air duct 120 and the bracket insertion portion 306 to flow to the air outlet 129.

The bracket insertion portion 306 can perform a function of fixing the sealing bracket 30 to the mask body 10 while defining one surface of the air duct 120.

In detail, an upper portion of the sealing bracket 30 can be fixed to the upper portion of the mask body 10 by the first body coupling portion 304, a lower portion of the sealing bracket 30 can be fixed to the lower portion of the mask body 10 by the second body coupling portion 305, and an intermediate portion of the sealing bracket 30 can be fixed to an intermediate portion of the mask body 10 by the bracket insertion portion 306.

The seal 40 can be made of a material having elasticity. The seal 40 can be in close contact with the user's face and deformed to correspond to a facial contour of the user. The seal 40 can be provided in a ring shape forming a closed loop. The seal 40 can be provided to cover the user's nose and mouth.

The seal 40 includes a coupling portion **400*a* coupled to the mask body 10, a side surface portion 400*c* extending from the coupling portion 400*a* toward the user's face, and a contact portion 400*b* that is bent from an end of the side surface portion 400*c* to extend toward the coupling portion 400*a***.

The contact portion **400*b* can be a portion that is in close contact with the user's face, and the side surface portion 400*c* and the contact portion 400*b* can be angled at an angle of about 90 degrees or less to define a space between the side surface portion 400*c* and the contact portion 400*b***.

A first opening can be defined inside the coupling portion **400*a* of the seal 40, and a second opening can be defined inside the contact portion 400*b*. As illustrated in FIG. 3**, the second opening can include a main opening in which the front of the user's nose and mouth are disposed and a sub opening extending from an upper end of the main opening and disposed on the user's nose.

In some examples, a lower portion of the main opening, that is, a portion that is in close contact with the front of the user's jaw can be designed closer to the mask body 10 than a portion that is in close contact with the front of the user's cheek.

In some implementations, a plurality of ventilation holes can be defined in the contact portion 400*b* to minimize a phenomenon in which moisture is generated on the user's cheek. The plurality of ventilation holes can have different sizes, and as an example, a diameter of the ventilation hole can gradually increase from an inner edge to an outer edge of the contact portion 400*b*.

The air outlet 129 and the air exhaust holes 154 and 155 can be provided inside the first opening, and the user's nose and mouth can be disposed inside the second opening.

The seal 40 is disposed between the user's face and the mask body 10, and the breathing space S is defined by the coupling portion 400*a*, the contact portion 400*b*, and the inner side of the side surface portion 400*c* of the seal 40.

A bracket insertion groove 401 can be defined in an end of the coupling portion 400*a* of the seal 40.

The bracket insertion groove 401 can be understood as a groove or a space defined between the two seal lips when the coupling portion 400*a* has the shape that is branched into the two seal lips as described above, and the bracket insertion portion 306 of the sealing bracket 30 is inserted into the bracket insertion groove 401.

The seal 40 includes a first seating portion 404 on which the first body coupling portion 304 is seated, a second seating portion 405 on which the second body coupling portion 305 is seated, and a third seating portion 406 on which the bracket insertion portion 306 is seated.

The first and third seating portions 404 and 406 can be understood as grooves in which a portion of the seal 40 is cut to form an accommodation space in which the first body coupling portion 304 and the bracket insertion portion 306 are accommodated. In some examples, the second seating portion 405 can be understood as a hole in which a portion of the seal 40 is cut to pass through the second body coupling portion 305.

In another aspect, the first seating portion 404 can be defined as a first opening, the second seating portion 405 can be defined as a second opening, and the third seating portion 406 can be defined as a third opening.

Figure 6:
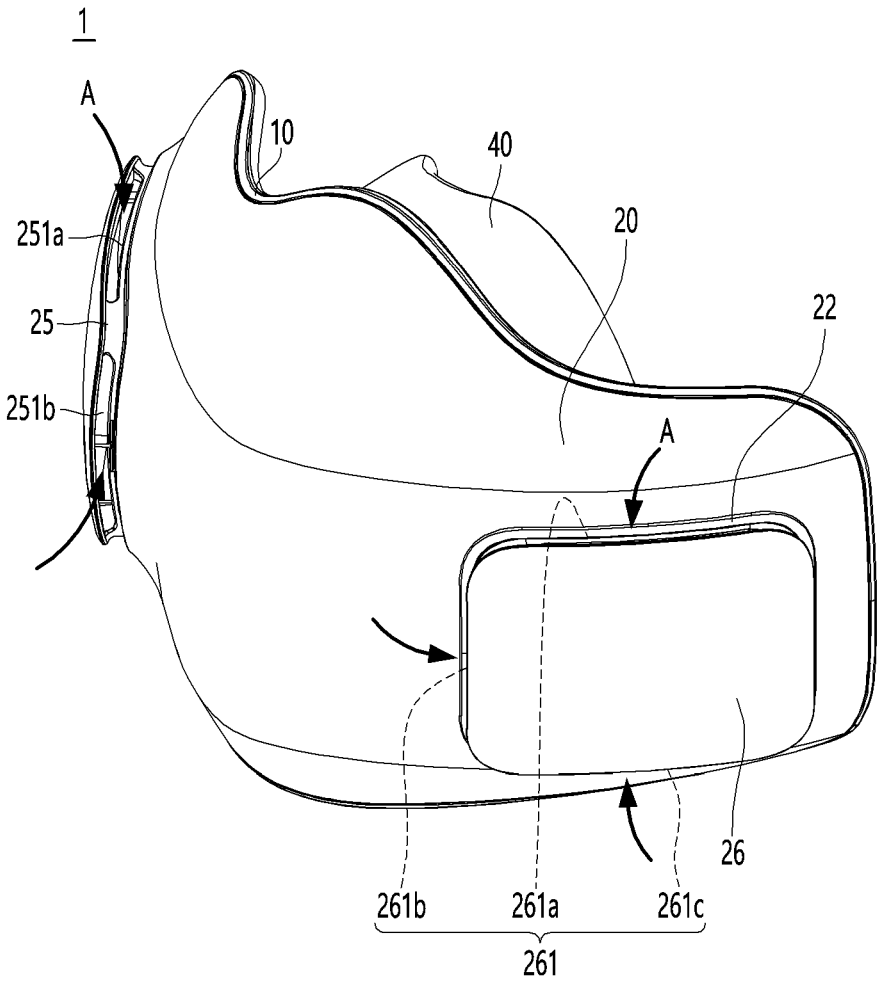
FIGS. 6 and 7 are views illustrating examples of a flow of air when the mask apparatus is operated.
Figure 7:
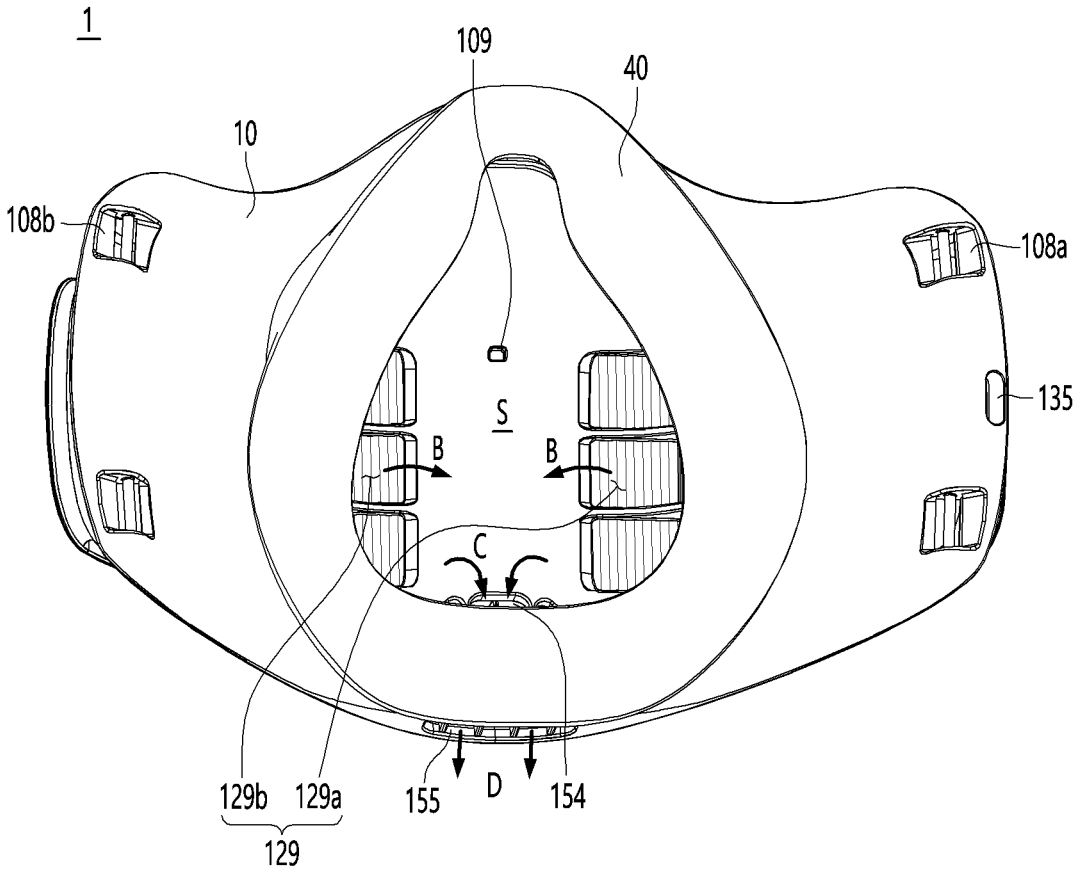

FIGS. 6 and 7 are views illustrating examples of a flow of air when the mask apparatus is operated.

Referring to FIGS. 6 and 7, the mask apparatus 1 can suction the external air through the air inlets 251 and 261 provided in the filter covers 25 and 26. The flow direction of the external air suctioned into the mask apparatus 1 is indicated by an arrow "A" Since the air inlets 251 and 261 are provided in plurality to suction the air in various directions, an inflow rate of the external air increases.

For example, the air inlets 251 and 261 can include air inlets 251*a* and 261*a* configured to suction air flowing at upper sides of the filter covers 25 and 26, air inlets 251*b* and 261*b* configured to suction air flowing at a front side of the filter covers 25 and 26, and air inlets 251*c* and 261*c* configured to suction air flowing at a lower side of the filter covers 25 and 26. The side air inlets 251*b* and 261*b* can be provided at one or both sides of the left and right sides of the filter covers 25 and 26.

Since the filter covers 25 and 26 in which the air inlets 251 and 261 are provided are respectively disposed at left and right sides of the front surface of the mask apparatus 1, the external air can be smoothly suctioned from the left and right sides of the front surface of the mask apparatus 1.

The external air introduced through the air inlets 251 and 261 can be filtered by passing through the filters 23 and 24 disposed inside the filter mounting portions 21 and 22. The filters 23 and 24 can be replaced when the filter covers 25 and 26 are separated from the mask apparatus 1.

The air passing through the filters 23 and 24 can be introduced into the suction holes of the fan modules 16 and 17 through the air suction holes 211 and 221. Since the filter mounting portions 21 and 22 in which the air suction holes 211 and 221 are defined and the fan modules 16 and 17 are assembled in the state of being in close contact with each other, the air passing through the filter can be prevented from leaking, or the external air can be prevented from being introduced between the filter mounting portions 21 and 22 and the fan modules 16 and 17.

The air discharged through the fan outlets of the fan modules 16 and 17 can pass through the air duct 120 to flow into the breathing space S through the air outlet 129. A flow direction of the air introduced into the breathing space S through the air outlet 129 is indicated by an arrow "B."

The breathing space S can be defined by the mask body 10 and the seal 40. When the mask body 10 is put on the user's face, the seal 40 can be in close contact with the mask body 10 and the user's face to form an independent breathing space that is separated from the external space.

The air that the user exhales after suctioning the filtered air supplied through the air outlet 129 can be exhausted to the external space through the air exhaust holes 154 and 155.

As described above, the air exhaust holes 154 and 155 include a first air exhaust hole 154 communicating with the breathing space and a second air exhaust hole 155 communicating with the external space, and the first air exhaust hole 154 and the second air exhaust hole 155 can communicate with each other by the flow space defined by the air discharge portion 150. The air exhaled by the user can be guided into the flow space through the first air exhaust hole 154. A flow direction of the air flowing into the flow space through the first air exhaust hole 154 is indicated by an arrow "C."

The air guided into the flow space through the first air exhaust hole 154 can be discharged to the external space through the second air exhaust hole 155. A flow direction of the air flowing to the external space through the second air exhaust hole 155 is indicated by an arrow "D."

Hereinafter, constituents of an ear hook portion will be described in more detail with reference to the accompanying drawings.

Figure 8:
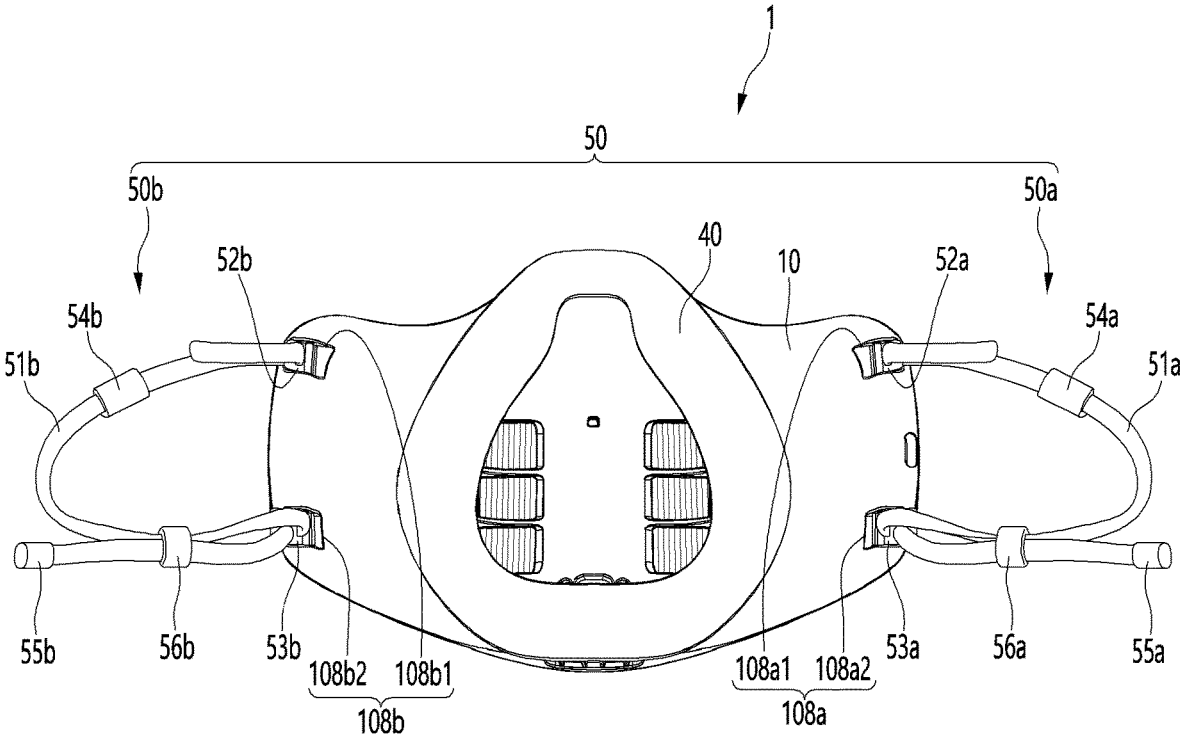
FIG. 8 is a view illustrating an example of a mask apparatus including an ear hook portion.
Figure 9:
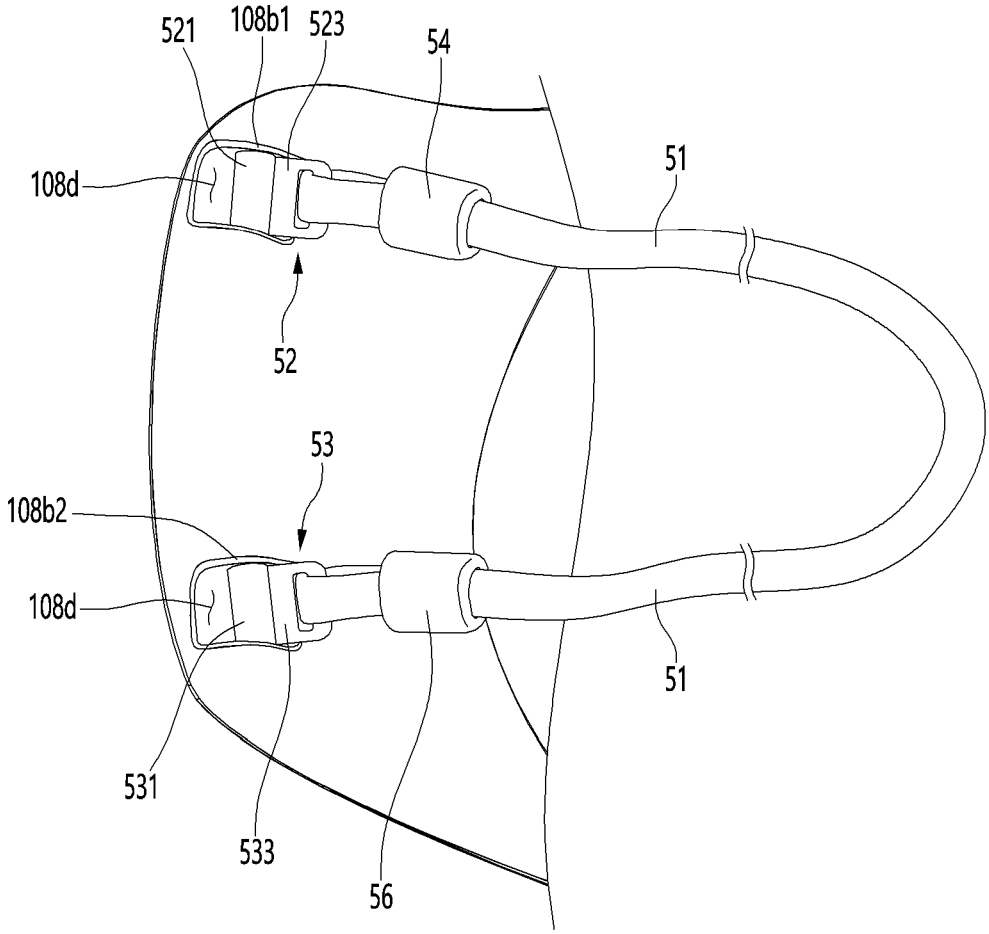
FIG. 9 is a view illustrating the ear hook portion mounted on an example of a mask body.
Figure 10:
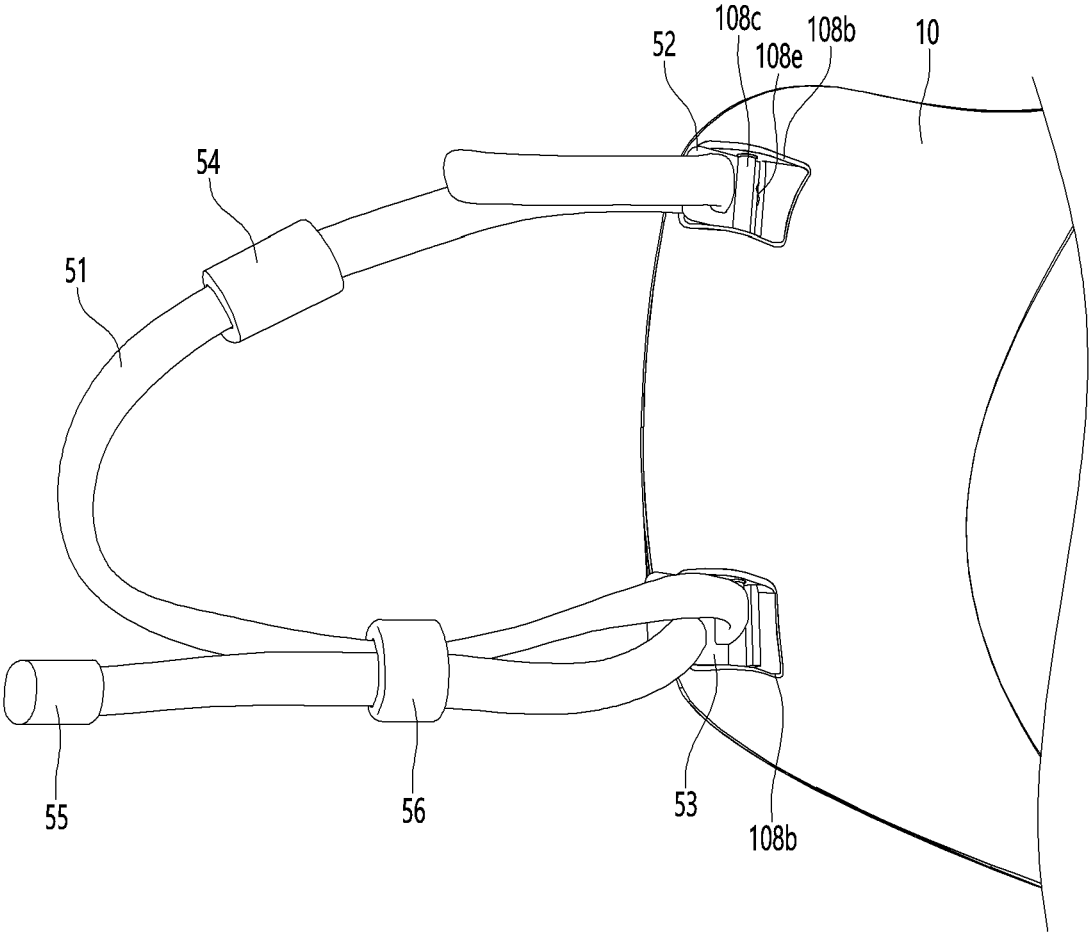
FIG. 10 is a view illustrating the ear hook portion mounted on the mask body.

FIG. 8 is a view illustrating an example of a mask apparatus including an ear hook portion, FIG. 9 is a view illustrating the ear hook portion mounted on an example of a mask body, and FIG. 10 is a view illustrating the ear hook portion rotated in a state of being mounted on the mask body.

Figure 11:
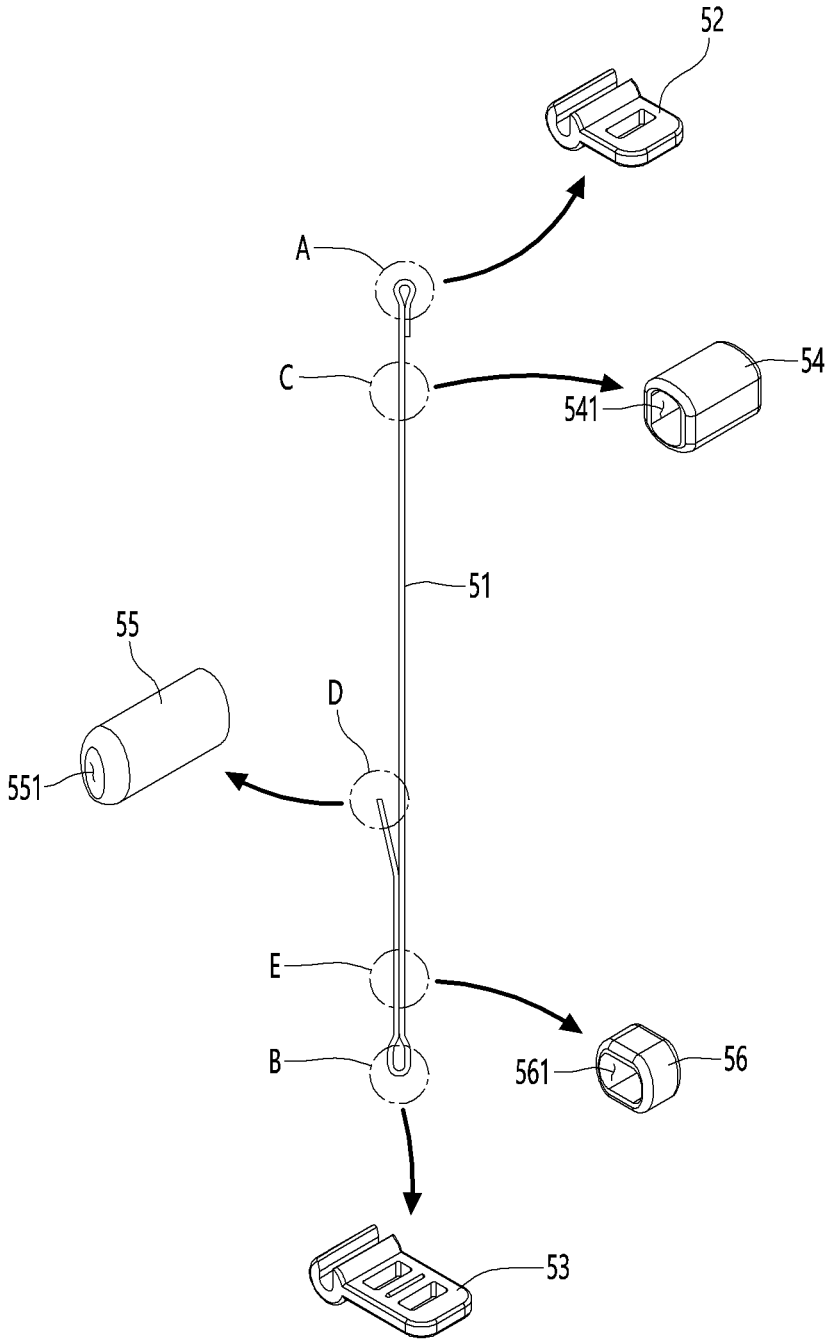
FIG. 11 is an exploded view illustrating the ear hook portion.
Figure 12:
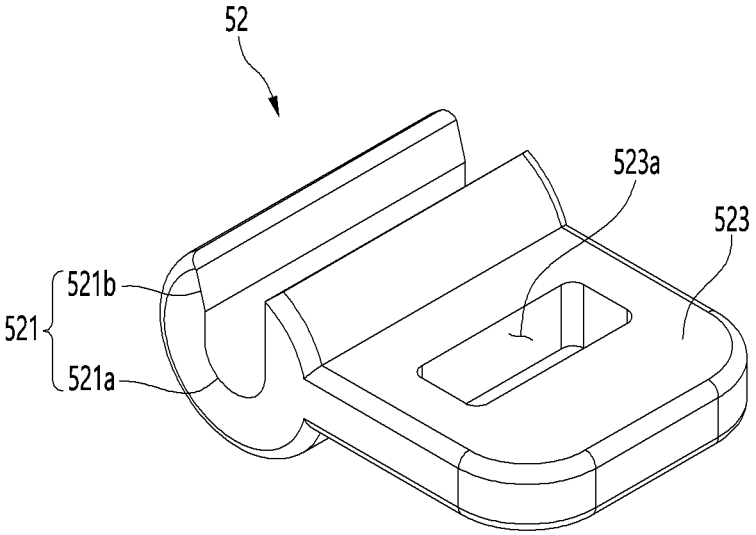
FIG. 12 is a perspective view illustrating an example of a first hook portion.
Figure 13:
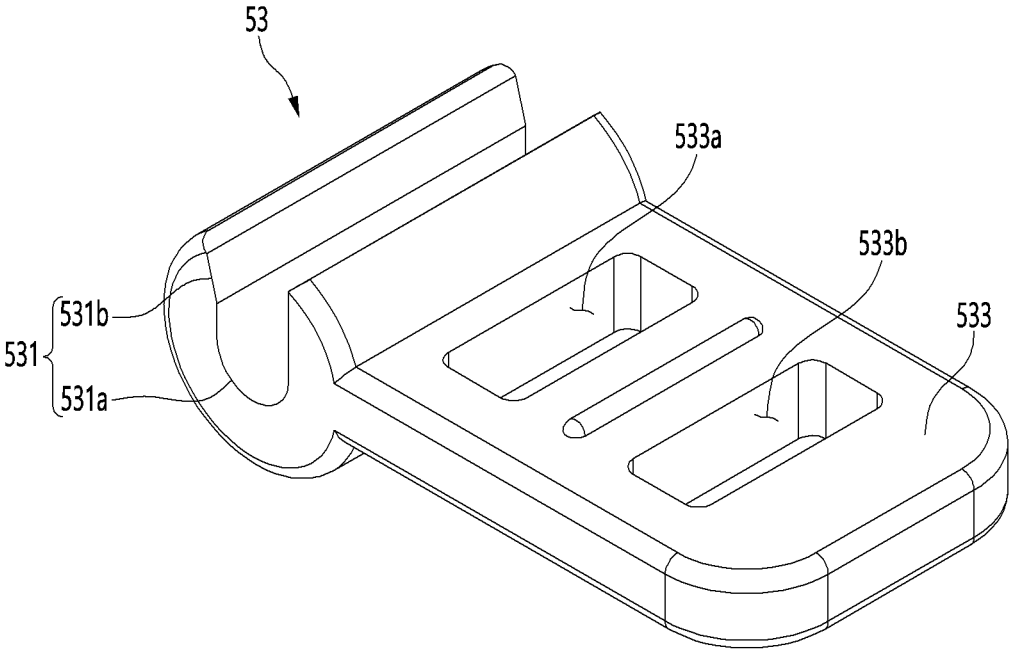
FIG. 13 is a perspective view illustrating an example of a second hook portion.

FIG. 11 is a view illustrating an example of an entire configuration of the ear hook portion, FIG. 12 is a perspective view showing an example of a first hook portion, and FIG. 13 is a perspective view showing an example of a second hook portion.

Referring to FIGS. 8 to 13, the mask apparatus 1 includes an ear hook portion 50 that is detachably coupled to the mask body 10.

The ear hook portion 50 can be understood as a constituent for allowing the mask apparatus 1 to be in close contact with a user's face. One side of the ear hook portion 50 can be fixed to the mask body 10, and the other side can be fixed to the user's ear to prevent the mask apparatus 1 from being spaced or separated from the user's face.

The ear hook portion 50 can include a band or rope for wearing the mask apparatus 1 on the user's face. The ear hook portion 50 can have a strap structure including the band or rope. In some examples, a length of the band or rope can be adjusted in a state in which the ear hook portion 50 is hung on the user's ear to adjust contact strength between the mask apparatus 1 and the user's face.

Particularly, the ear hook portion 50 can be provided on both sides of the mask body 10, respectively. That is, the ear hook portion 50 can include a first ear hook portion 50*a* installed at a left side of the mask body 10 and a second ear hook portion 50*b* installed at a right side.

The first ear hook portion 50*a* can be coupled to a first hook mounting portion 108*a* provided at one side of the mask body 10, and the second ear hook portion 50*b* can be coupled to a second hook mounting portion 108*b* provided at the other side of the mask body 10.

The first ear hook portion 50*a* can be coupled to a pair of first hook mounting portions 108*a* that are spaced apart from each other in a vertical direction at one side of the mask body 10, and the second ear hook portion 50*b* can be coupled to a pair of second hook mounting portions 108*b* that are spaced apart from each other in the vertical direction at the other side of the mask body 10.

The first ear hook portion 50*a* and the second ear hook portion 50*b* can have the same shape and size. Therefore, hereinafter, it will be described in more detail with reference to the second ear hook portion 50*b*.

The ear hook portion 50 can include a strap portion 51; and hook portions 52 and 53 for fixing the strap portion 51 to the hook mounting portion 108.

The strap portion 51 can have a predetermined thickness and be provided to be long in a rope or string shape. The strap portion 51 can be a portion that is fixed to the user's ear and be made of a flexible and elastic material.

The strap portion 51 can be provided in a state in which at least a portion thereof is rolled or folded. The strap portion 51 can be fixed by a fixing member in a state in which at least a portion thereof is rolled. In some examples, the rolled portion of the strap portion 51 can be pulled to adjust a length of the ear hook portion 50 so that the mask apparatus 1 is in close contact with the user's face.

Referring to FIG. 11, the strap portion 51 can extend by a predetermined length. One end of the strap portion 51 can be folded to face the other end of the strap portion 51, and the other end of the strap portion 51 can be folded to face the one end of the strap portion 51.

That is, the strap portion 51 can include a first end defining one end and a second end defining the other end, and both the ends of the strap portion 51 can be folded or curved in a direction in which the first end and the second end are close to each other.

The hook portions 52 and 53 are coupled to the strap portion 51 to serve to connect the mask apparatus 1 to the strap portion 51. Each of the hook portions 52 and 53 has one side in which a hole, through which the strap portion 51 passes, is defined and the other side that is hooked and coupled to the mask body 10. The hook portions 52 and 53 can be provided in plurality.

In detail, the hook portions 52 and 53 can include a first hook portion 52 coupled to an upper portion of the strap portion 51 and a second hook portion 53 coupled to a lower portion of the strap portion 51.

The first hook portion 52 is coupled to an upper second hook mounting portion 108*b*1 provided on the upper portion of the mask body 10, and the second hook portion 53 is coupled to a lower second hook mounting portion 108*b*2 provided on the lower portion of the mask body 10.

The first hook portion 52 and the second hook portion 53 can have different sizes and shapes to help the user to avoid erroneous assembly or confusion between the first hook portion 52 and the second hook portion 53. Accordingly, the second hook mounting portions 108*b*1 and 108*b*2 to which the first hook portion 52 and the second hook portion 53 are respectively coupled can be designed to have shapes and sizes different from each other.

For example, like the second hook mounting portion 108*b*, the first hook mounting portion 108*a* can include an upper first hook mounting portion 108*a*1 and a lower first hook mounting portion 108*a*2. The upper first hook mounting portion 108*a*1 and the upper second hook mounting portion 108*b*1 can be defined as upper hook mounting portions, and the lower first hook mounting portion 108*a*2 and the lower second hook mounting portion 108*b*2 can be defined as lower hook mounting portions.

The first hook portion 52 can include a first hook body 521, in which a hook groove 521*a* and a guide opening 521*b* are defined, and a first hook extension portion 523 extending from an outer surface of the first hook body 521. The first hook portion 52 can be integrally provided as a plastic injection molded product. Referring to FIG. 11, the first hook portion 52 can be coupled to an upper end portion A of the strap portion 51. The first hook body 521 can have a cylindrical shape, and a hook groove 521*a* can be defined inside the first hook body 521. The hook groove 521*a* is a portion that is hooked on a hook pin 108*c* disposed inside the second hook mounting portion 108*b*.

Here, the second hook mounting portion 108*b* can be recessed forward from the rear surface of the mask body 10 to form a recessed space 108*d*, and the hook pin 108*c* can be provided in a vertical bar shape connecting a top surface to a bottom surface of the recessed space 108*d*.

The hook groove 521*a* can be recessed to a size that the hook pin 108*c* cab be rotatably accommodated. The hook groove 521*a* can be recessed up to a central portion of the first hook body 521, and the inside thereof can be provided to be rounded. Here, the bottom of the hook groove 521*a* can be rounded to correspond to a diameter of the hook pin 108*c*. Thus, in a state where the hook pin 108*c* is coupled to the hook groove 521*a*, the first hook body 521 can rotate. In some examples, the guide opening 521*b* is a portion that is opened from an outer circumferential surface of the first hook body 521 to the hook groove 521*a*. In order to facilitate the insertion of the hook pin 108*c* in the guide opening 521*b*, the guide opening 521*b* can be designed in a shape that is wider from the hook groove 521*a* to the outer circumferential surface of the first hook body 521.

The first hook extension portion 523 extends from an outer circumferential surface of the first hook body 521 and is a portion through which the strap portion 51 passes to be coupled. The first hook extension portion 523 can extend radially outward from the outer circumferential surface of the first hook body 521. The first hook extension portion 523 can have a plate shape.

A through-hole 523*a* through which the strap portion 51 passes can be defined in the first hook extension portion 523. The through-hole 523*a* can be defined to be larger than a width, thickness or diameter of the strap portion 51.

Here, the through-hole 523*a* and the hook groove 521*a* can be designed to be opened in the same direction. That is to say, the first hook extension portion 532 can be designed so that the direction in which the hook pin 180*c* is inserted into the hook groove 521*a* and the direction in which the strap portion 51 passes through the through hole 523*a* are parallel to each other.

The second hook portion 53 can include a second hook body 531, in which a hook groove 531*a* and a guide opening

531*b* are defined, and a second hook extension portion 533 extending from an outer surface of the second hook body 531. The second hook portion 53 can be integrally provided as a plastic injection molded product. Referring to FIG. 11, the second hook portion 53 can be coupled to a lower end portion B of the strap portion 51. The hook groove 521*a* can be defined as a first hook groove, and the hook groove 531*a* can be defined as a second hook groove.

The second hook portion 53 can be produced through plastic injection molding.

The second hook body 531 can have a cylindrical shape, and the hook groove 531*a* can be defined inside the first hook body 521. The hook groove 531*a* is a portion that the hook pin 108*c* disposed inside the second hook mounting portion 108*b* is hooked and restrained.

The hook groove 531*a* can be designed to have the same shape as the hook groove 521*a*, and in a state where the hook pin 108*c* is coupled to the hook groove 531*a*, the second hook body 531 can be rotatable with respect to the first hook pin 108*c*.

Like the first hook extension portion 523, the second hook extension portion 533 extends from an outer circumferential surface of the second hook body 531 and is a portion through which the strap portion 51 passes to be coupled. The second hook extension portion 533 can extend radially outward from the outer circumferential surface of the second hook body 531. The second hook extension portion 533 can have a plate shape.

Through-holes 533*a* and 533*b* can be defined in the second hook extension portion 533 to allow the strap portion 51 to pass therethrough.

Here, the through-holes 533*a* and 533*b* can be provided in plurality, such that the strap portion 51 can continuously pass through the through-holes 533*a* and 533*b*. For example, the through-holes 533*a* and 533*b* can include a primary through-hole 533*a*, through which the strap portion 51 primarily passes, and a secondary through-hole 533*b*, through which the strap portion 51 passing through the primary through-hole 533*a* secondarily passes.

Each of the primary through-hole 533*a* and the secondary through-hole 533*b* can be defined to be greater than a width, a thickness, or a diameter of the strap portion 51. The primary through-hole 533*a* and the secondary through-hole 533*b* can have the same size and shape. The primary through-hole 533*a* and the secondary through-hole 533*b* can be disposed side by side in the second hook extension portion 533.

The primary through-hole 533*a* and the secondary through-hole 533*b* can be disposed to be spaced outward from the second hook extension portion 533 in the radial direction of the second hook body 531. Here, the primary through-hole 533*a*, the secondary through-hole 533*b*, and the hook groove 531*a* can be opened to face the same direction.

With this configuration, the strap portion 51 can pass through the primary through-hole 533*a* in a first direction, and then pass through the secondary through-hole 533*b* in a second direction opposite to the first direction. Thus, the overall length of the strap portion 51 can be adjusted to be shortened or lengthened.

To connect the ear hook portion 50 to the second hook mounting portion 108*b*, the first hook portion 52 and the second hook portion 53 can be coupled to the second hook mounting portions 108*b*, which are provided on the upper and lower portions of the mask body 10, respectively.

In detail, a hook pin 108*c* disposed inside the second hook mounting portion 108*b* is inserted into the hook groove 521*a* of the first hook portion 52 and the hook groove 531*a* of the second hook portion 53.

In this case, as illustrated in FIGS. 3 and 10, a portion of the second hook mounting portion 108*b* defining the recessed space 108*d* is cut so that the hook bodies 521 and 531 and the second hook mounting portion 108*b* do not interfere with each other. The cutoff portion can be provided in the form of the through-hole 108*e* passing through the second hook mounting portion 108*b*.

In some examples, external air can be introduced into a space defined between the mask body 10 and the mask body cover 20 through the through-hole 108*e* to cool the control module 18 and the power module 19.

On the other hand, when the external air is introduced into the space between the mask body 10 and the mask body cover 20 through the through-hole 108*e*, dusts and contaminants can be introduced together and thus be accumulated in the control module 18 or the power module 19. Therefore, in the state where the user wears the mask apparatus 1, that is, when the fan modules 16 and 17 are operating, it is necessary to minimize the phenomenon in which the external air is introduced into the mask apparatus 1 through the through-hole 108*e*.

To minimize this phenomenon, the through-hole 108*e* can have a size corresponding to the size of each of the hook bodies 521 and 531. Thus, when the user wears the mask apparatus 1, the through-hole 108*e* can be shielded by the hook bodies 521 and 531.

Particularly, the through-hole 108*e* can have a length corresponding to the length of each of the hook bodies 521 and 531 and a width corresponding to an outer diameter of each of the hook bodies 521 and 531, each of which is provided in a cylindrical shape.

To prevent the hook pin 180*c* from being separated from the hook grooves 521*a* and 531*a* in a process of wearing or taking off the mask apparatus 1, it can be designed so that an opening direction of the hook grooves 521*a* and 531*a*, that is, a direction in which the hook pin 180*c* is inserted and an extension direction of each of the hook extension portions 523 and 533 cross each other.

For example, an angle angled between the opening direction of the hook grooves 521*a* and 531*a* and the extension direction of the hook extension portions 523 and 533 can be designed to be 90 degrees or less.

The ear hook portion 50 can further include a first band 54 coupled to the strap portion 51.

The first band 54 can bind one end of the strap portion 51 to hold the strap portion 51 in the form of a band. A hole 541 through which the strap portion 51 passes can be defined inside the first band 54. The first band 54 can be made of a flexible and elastic material.

In detail, based on the folded portion of the strap portion 51, a strap body defining a front portion of the folded portion and a strap end defining a rear portion of the folded portion can pass through a hole 541 of the first band 54. As a result, the strap portion 51 connected to the first hook portion 52 may not be easily released by external force.

That is, after the end of the strap portion 51 sequentially passes through the hole 541 of the first band 54 and the first hook portion 52, the strap portion 51 can be bent at an angle of about 180 degrees to pass through the hole 541, thereby restricting the strap portion 51 from being released by itself and separated from the first hook portion 52.

Referring to FIG. 11, the first band 54 can couple a first end defining one end of the strap portion 51 and a portion C of the strap portion 51 to form one body. The first band 54 can function to finish an end of one side of the strap portion 51.

The ear hook portion 50 can further include a second band 55 coupled to the strap portion 51.

The second band 55 can bind the other end of the strap portion 51 to hold the strap portion 51 in the form of a band. A hole 551 through which the strap portion 51 passes can be defined inside the second band 55. The second band 55 can be made of a flexible and elastic material.

Referring to FIG. 11, the second band 55 can be inserted into a second end D defining the other end of the strap portion 51. The second band 55 can function to finish an end of the other side of the strap portion 51.

The ear hook portion 50 can further include a length adjustment portion 56 coupled to the strap portion 51.

The length adjustment portion 56 binds a portion of the strap portion 51 to hold the strap portion 51 in the form of a band. In some implementations, the length adjustment portion 56 functions to adjust a length of the strap portion 51 so that the mask apparatus 1 is in close contact with the wearer's face.

A hole 561 through which the strap portion 51 passes can be defined inside the length adjustment portion 56. The length adjustment portion 56 can be made of a flexible and elastic material. In some cases, the length adjustment portion 56 can include a tube shape or a ring shape having an opening configured to receive the strap portion 51 (e.g., the second end of the strap portion and the body portion of the strap portion).

Referring to FIG. 11, the length adjustment portion 56 can be provided at a point E between the second hook portion 53 and the second band 55. For instance, the strap portion 51 can pass through the hole 561 of the length adjustment portion 56 and then pass through the primary through-hole 533*a* of the second hook portion 53. In some implementations, the strap portion 51 passing through the primary through-hole 533*a* may pass through the secondary through-hole 533*b* and then pass through the hole 561 of the length adjustment portion 56 again.

That is, the length adjustment portion 56 can bind a portion of a strap portion 51, which extends from the length adjustment portion 56 to the primary through-hole 533*a* of the second hook portion 53, to a portion of the strap portion 51, which extends from the secondary through-hole 533*b* of the second hook portion 53 to the length adjustment portion 56 to hold the strap portion 51 in the form of the band.

With this configuration, the wearer can adjust the length of the ear hook portion 50 by pulling a portion of the strap portion 51, which corresponds between the length adjustment portion 56 and the second hook portion 53.

Figure 14:
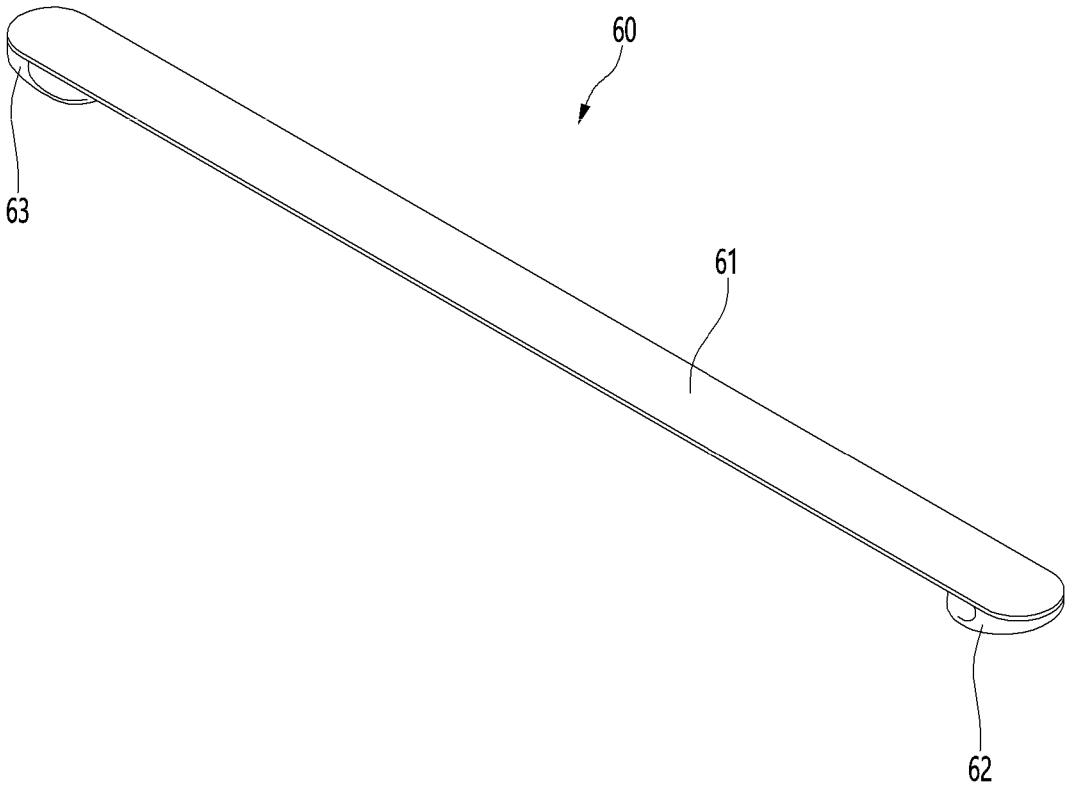
FIG. 14 is a perspective view illustrating an example of a neck band.
Figure 15:
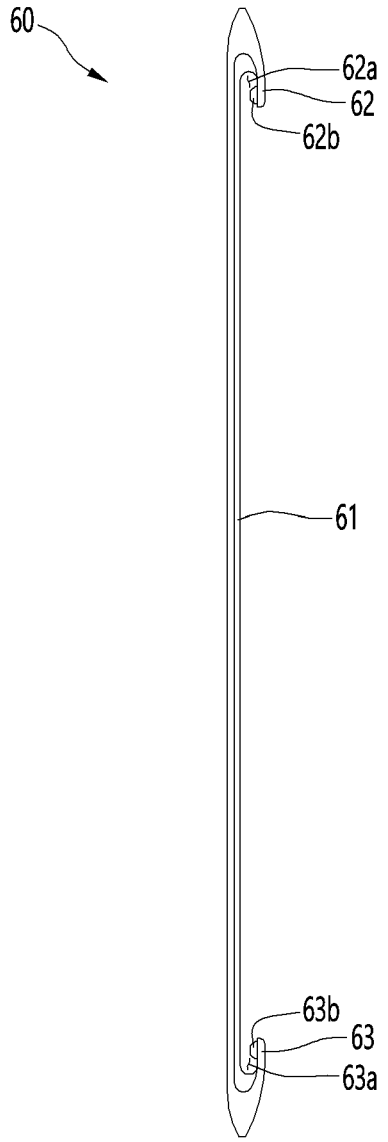
FIG. 15 is a front view illustrating the neck band.
Figure 16:
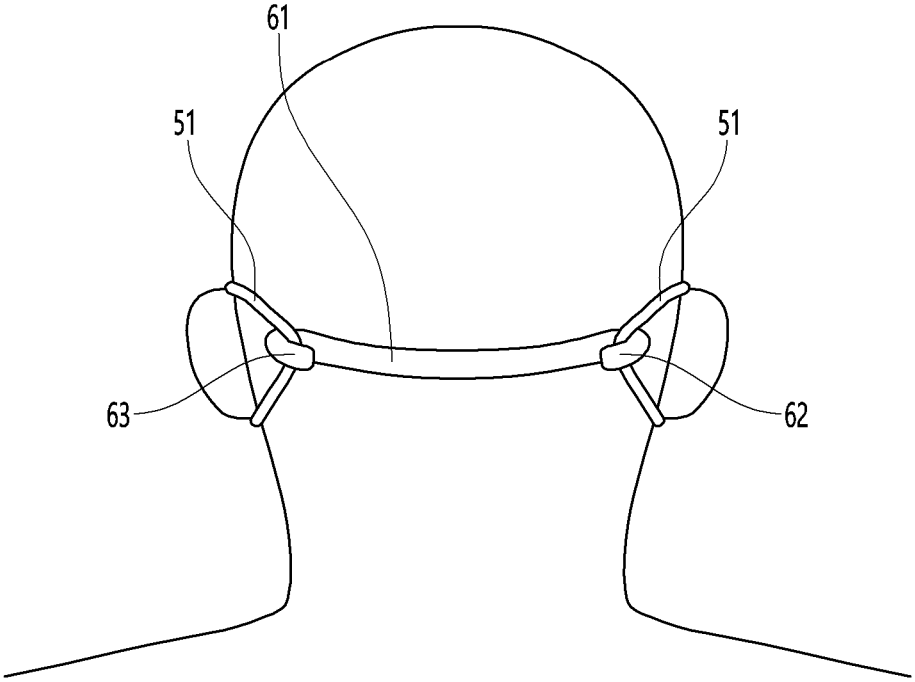
FIG. 16 is a view illustrating the neck band connected to the ear hook portions.

FIG. 14 is a perspective view showing an example of a neck band, FIG. 15 is a front view showing the neck band, and FIG. 16 is a view illustrating the neck band connected to the ear hook portion.

Referring to FIGS. 14 to 16, the mask apparatus 1 can further include a neck band 60.

The neck band 60 can be understood as an auxiliary constituent for connecting the ear hook portions 50, which are respectively mounted on both sides of the mask body 10, to allow the mask apparatus 1 to be in close contact with the wearer's face. Both ends of the neck band 60 can be worn on a neck or occiput by hanging the ear hook portions 50 hooked on both ears to each other.

In some implementations, the neck band 60 can include a band body 61 that extends to be elongated in the left and right direction, and hooking portions 62 and 63, which are respectively provided in the form of a hook at both ends of the band body 61.

The band body 61 can be provided in a straight or curved strip shape. In some implementations, a first hooking portion 62 to which the strap portion 51*a* of the first ear hook portion 50*a* is hook-coupled can be disposed on one end of the band body 61, a second hooking portion 63 to which the strap portion 51*b* of the second ear hook portion 50*b* is hook-coupled can be disposed on the other end of the band body 61.

To allow the strap portion 51 to be hooked on the first hooking portion 62, the first hooking portion 62 can be provided by bending one end of the band body 61 toward a center of the band body 61. Here, a first space 62*a* in which the strap portion 51 is disposed can be defined between the first hooking portion 62 and the band body 61.

In some examples, a first hook protrusion 62*b* for hooking and restraining the strap portion 51 can be disposed on an inner surface of the first hooking portion 62 defining the first space 62*a*. The first hook protrusion 62*b* can protrude from the inner surface of the first hooking portion 62 to a predetermined length toward the band body 61.

In some implementations, to allow the strap portion 51 to be hooked on the second hooking portion 63, the second hooking portion 63 can be provided by bending the other end of the band body 61 toward the center of the band body 61. Here, a second space 63*a* in which the strap portion 51 is disposed can be defined between the second hooking portion 63 and the band body 61.

In some implementations, a second hook protrusion 63*b* for hooking and restraining the strap portion 51 can be disposed on an inner surface of the second hooking portion 63 defining the second space 63*a*. The second hook protrusion 63*b* can protrude from the inner surface of the second hooking portion 63 to a predetermined length toward the band body 61.

The user can wear the strap portions 51 of the ear hook portion 50 by hanging the strap portions 51 on both the ears. In some implementations, a portion of the strap portion 51, which corresponds between the length adjustment portion 56 and the second hook portion 53, can be pulled to adjust the length of the ear hook portion 50 to allow the mask apparatus 1 to be in close contact with the wearer's face.

Additionally, the wearer can bind the both the ear hook portions 50 by hooking the hooking portions 62 and 63 of the neck band 60 to the strap portions 51, which are respectively hung on the ear hook portion 50. According to this configuration, even if the mask apparatus is used for a long time, the mask apparatus may not be separated from the wearer's face, and the position of the mask apparatus can be stably fixed. Furthermore, a phenomenon in which the strap or strap portion 51 presses the rear surface of the ear to cause pain can be prevented.

What is claimed is:

1. A mask apparatus comprising:

a mask body;

a mask body cover coupled to a front surface of the mask body;

a pair of hook mounting portions that are disposed at side ends of the mask body, respectively, each of the pair of hook mounting portions comprising a recessed space that is recessed from a rear surface of the mask body toward the mask body cover such that the pair of hook mounting portions are covered by the mask body cover from an outside of the mask apparatus;

a seal coupled to the rear surface of the mask body and configured to define a breathing space therein; and a pair of ear hook portions that are configured to be connected to the pair of hook mounting portions, respectively, wherein each of the pair of hook mounting portions comprises:

an upper hook mounting portion disposed at one of the side ends of the mask body, a lower hook mounting portion disposed at the one of the side ends of the mask body and positioned vertically below the upper hook mounting portion, a hook pin disposed at each of the upper hook mounting portion and the lower hook mounting portion, and a through-hole defined in at least one of the upper hook mounting portion or the lower hook mounting portion and configured to introduce external air into an inner space between the mask body and the mask body cover to thereby cool electronic components provided in the inner space, and wherein each of the pair of ear hook portions comprises:

a strap portion, a first hook portion configured to connect a first end of the strap portion to one of the upper hook mounting portion or the lower hook mounting portion, and a second hook portion configured to connect a second end of the strap portion to the other of the upper hook mounting portion or the lower hook mounting portion.

2. The mask apparatus according to claim 1, wherein each of the first hook portion and the second hook portion comprises:

a hook body having a cylindrical shape, the hook body being configured to be coupled to the hook pin; and a hook extension portion that extends from an outer circumferential surface of the hook body.

3. The mask apparatus according to claim 2, wherein the hook body defines:

a hook groove configured to receive the hook pin; and a guide opening that is recessed from the outer circumferential surface of the hook body configured to guide the hook pin to the hook groove.

4. The mask apparatus according to claim 3, wherein a first width of the guide opening at the hook groove is less than a second width of the guide opening at the outer circumferential surface of the hook body.

5. The mask apparatus according to claim 3, wherein at least a portion of the hook body is configured to be accommodated in the through-hole.

6. The mask apparatus according to claim 5, wherein a width of the through-hole corresponds to an outer diameter of the hook body, and wherein a length of the through-hole corresponds to a length of the hook body.

7. The mask apparatus according to claim 3, wherein the hook pin is configured to be inserted into the hook groove in a first direction, and wherein the hook extension portion extends in a second direction intersecting the first direction.

8. The mask apparatus according to claim 7, wherein an angle defined between the first direction and the second direction is less than or equal to 90 degrees.

9. The mask apparatus according to claim 3, wherein the hook extension portion defines one or more hook through-holes configured to receive the first end or the second end of the strap portion.

10. The mask apparatus according to claim 9, wherein each of the pair of ear hook portions further comprises a first band configured to couple the first end of the strap portion to a body portion of the strap portion, the first end of the strap portion passing through the one or more hook through-holes.

11. The mask apparatus according to claim 10, wherein each of the pair of ear hook portions further comprises a second band configured to receive the second end of the strap portion.

12. The mask apparatus according to claim 10, further comprising a length adjustment portion member configured to adjust a length of the strap portion disposed around an ear of a user, and wherein the length adjustment portion member includes an opening configured to allow the second end of the strap portion and the body portion of the strap portion to pass therethrough.

13. The mask apparatus according to claim 12, wherein the hook extension portion of the first hook portion defines one hook through-hole among the one or more hook through-holes, and wherein the hook extension portion of the second hook portion defines two hook through-holes among the one or more hook through-holes.

14. The mask apparatus according to claim 13, wherein the first band is configured to couple the first end of the strap portion, which passes through the one hook through-hole, to the body portion of the strap portion.

15. The mask apparatus according to claim 14, wherein each of the pair of ear hook portions further comprises a second band configured to receive the second end of the strap portion that passes through the two hook through-holes.

16. The mask apparatus according to claim 1, further comprising a neck band configured to connect the pair of ear hook portions to each other.

17. The mask apparatus according to claim 16, wherein the neck band comprises:

a band body; and a pair of hooking portions that are bent from ends of the band body and extend toward each other.

18. The mask apparatus according to claim 17, wherein the neck band further comprises a hook protrusion that protrudes from an end of each of the pair of hooking portions.

19. The mask apparatus according to claim 1, wherein the through-hole is configured to communicate air with the inner space defined between the mask body and the mask body cover and to decrease a temperature in the inner space.

20. The mask apparatus according to claim 19, wherein each of the first hook portion and the second hook portion is configured to, based on a user wearing the mask apparatus, block at least a portion of the through-hole.

* * * * *